US010386026B2

(12) United States Patent
Phillips et al.

(10) Patent No.: US 10,386,026 B2
(45) Date of Patent: Aug. 20, 2019

(54) LIGHT FIXTURE

(71) Applicants: EPISTAR CORPORATION, Hsinchu (TW); Ecoled Venture Co., Limited, Wanchai (HK)

(72) Inventors: Frederic Perry Phillips, Wanchai (HK); Wei-Chiang Hu, Hsinchu (TW)

(73) Assignee: EPISTAR CORPORATION, Hsinchu (TW)

( * ) Notice: Subject to any disclaimer, the term of this patent is extended or adjusted under 35 U.S.C. 154(b) by 0 days.

(21) Appl. No.: 16/002,423

(22) Filed: Jun. 7, 2018

(65) Prior Publication Data

US 2018/0356056 A1 Dec. 13, 2018

(30) Foreign Application Priority Data

Jun. 8, 2017 (CN) ..... 2017 1 0429282

(51) Int. Cl.

| | |
|---|---|
| ***F21S 8/02*** | (2006.01) |
| ***F21V 23/02*** | (2006.01) |
| ***F21V 17/16*** | (2006.01) |
| ***F21V 29/10*** | (2015.01) |
| *F21Y 115/10* | (2016.01) |

(52) U.S. Cl.

CPC ..... *F21S 8/026* (2013.01); *F21V 17/164* (2013.01); *F21V 23/023* (2013.01); *F21V 29/10* (2015.01); *F21Y 2115/10* (2016.08)

(58) Field of Classification Search

CPC ..... F21S 8/026; F21V 23/023; F21V 17/164
See application file for complete search history.

(56) References Cited

U.S. PATENT DOCUMENTS

| | | | | |
|---|---|---|---|---|
| 9,310,038 | B2 | 4/2016 | Athalye | |
| 9,494,294 | B2 | 11/2016 | Edmond et al. | |
| 2015/0233537 | A1 | 8/2015 | Athalye et al. | |
| 2017/0307198 | A1* | 10/2017 | Shah | F21K 9/68 |

* cited by examiner

*Primary Examiner* — Joseph L Williams
(74) *Attorney, Agent, or Firm* — Patterson + Sheridan, LLP

(57) ABSTRACT

The present disclosure discloses a light fixture, which includes a junction box, a first lid over the junction box, a first lid body hinged on the junction box, a second lid, a second lid body located between the second lid and junction box, and a space located between the junction box and the second lid body.

20 Claims, 21 Drawing Sheets

LIGHT FIXTURE

REFERENCE TO RELATED APPLICATION

This application claims the right of priority based on CN Application Serial No. 201710429282.0, filed Jun. 8, 2017, and the content of which is hereby incorporated by reference in its entirety

TECHNICAL FIELD

The present disclosure relates to a light fixture, in particular to a light fixture which is easily to be assembled.

DESCRIPTION OF BACKGROUND ART

Light-emitting diode (LED) for solid-state lighting devices have characteristics such as low power consumption, long lifetime, small size, high response speed and stable optical output, so that light-emitting diode gradually replace traditional lighting products and are applied to general household lighting or commercial lighting.

SUMMARY OF DISCLOSURE

A light fixture disclosed in the embodiments in accordance with the present disclosure includes a first lid, a first lid body, a second lid, a second lid body and a junction box. The first lid is over the junction box. The first lid body is hinged on the junction box. A space is between the junction box and the second lid body.

DETAILED DESCRIPTION OF THE PRESENT DISCLOSURE

Figure 1A:
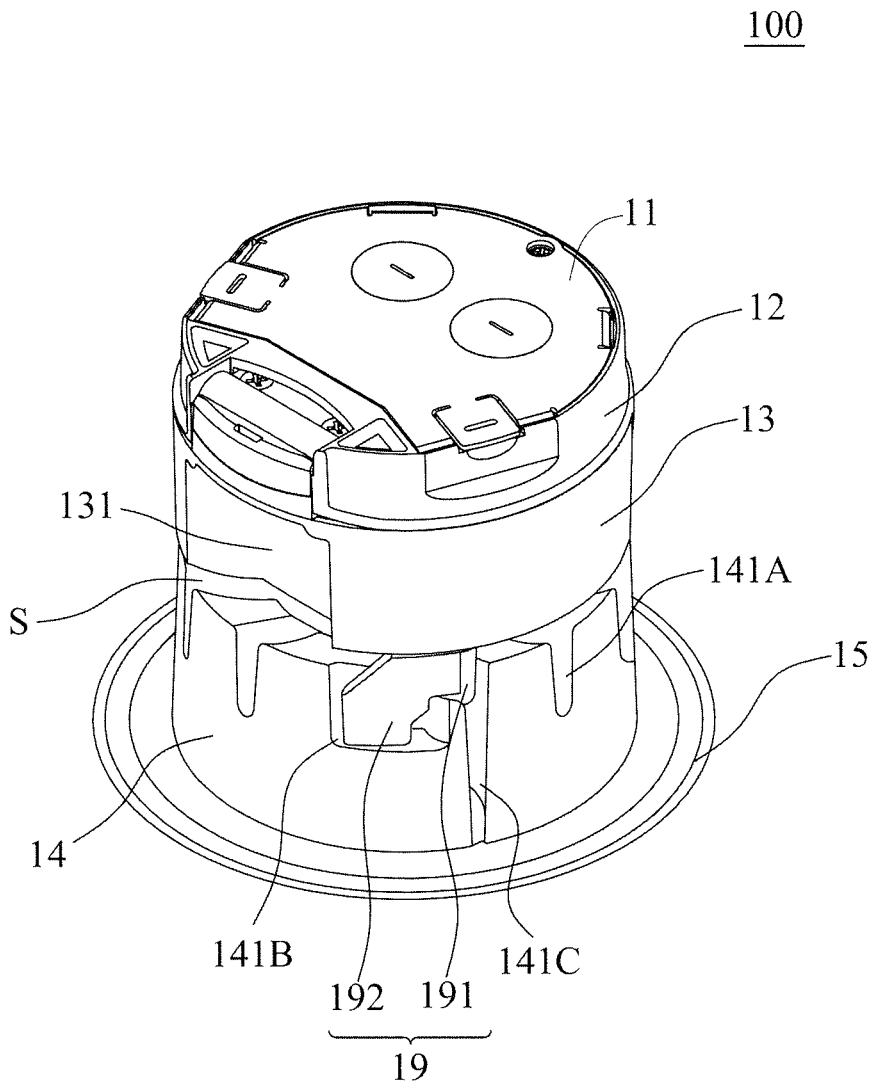
FIG. 1A is a perspective view of a light fixture in an embodiment of the present disclosure.

The following embodiments will explain the concept of the present disclosure with reference to the figures. In the drawings or the description, the same or similar portions use the same symbols, and in the drawings, the shape or thickness of the elements may be enlarged or reduced. It is important to note that elements not shown or described in the figures can be in the form known to those skilled in the art.

Figure 1B:
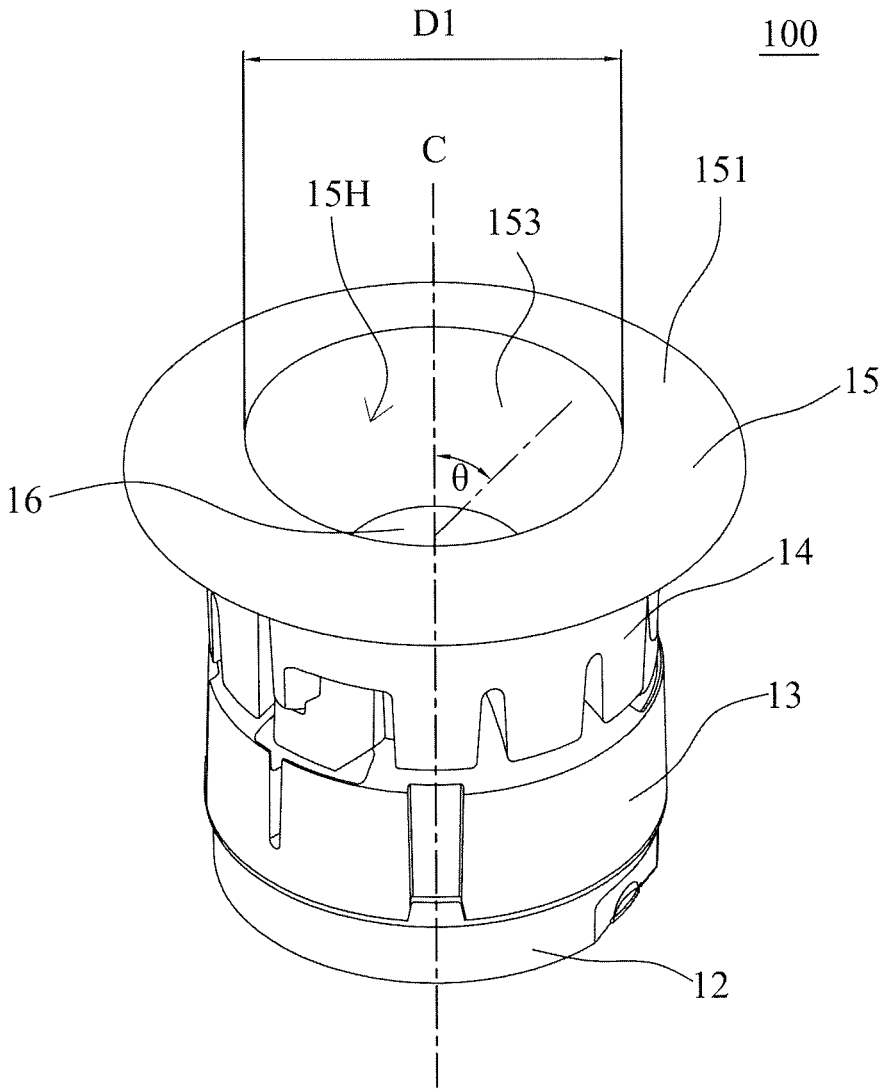
FIG. 1B is another perspective view of a light fixture in an embodiment of the present disclosure.

FIG. 1A shows a perspective view of a light fixture 100 in an embodiment of the present disclosure. FIG. 1B shows another perspective view of a light fixture 100 in an embodiment of the present disclosure.

The light fixture 100 includes a first lid 11, a first lid body 12, a junction box 13, a second lid body 14, a second lid 15, and a fastener 19. In this embodiment, the direction to the first lid 11 is defined as the upper direction, and the direction to the second lid 15 is defined as the lower direction. Therefore the order from top to bottom is the first lid 11, the first lid body 12, the junction box 13, the second lid body 14 and a second lid 15 in FIG. 1A. The second lid body 14 has a plurality of first grooves 141A, a plurality of second grooves 141B and a plurality of third grooves 141C. The widths of the first groove 141A and the third groove 141C are smaller than the width of the second groove 141B. However, the first groove 141A may also be greater than or equal to the width of the second groove 141B in design. The depths of the first groove 141A and the second groove 141B may be the same or different. The depth of the third groove 141C is greater than the depths of the first groove 141A and the second groove 141B. The first groove 141A or/and the second groove 141B or/and the third groove 141C may increase the contact area of the second lid body 14 with an external environment (for example, air) to help heat dissipation. The fastener 19 has a first portion 191 and a second portion 192 located in the third groove 141C. The second groove 141B is used for receiving the second portion 192 therein, so that the light fixture 100 can be in the storage state (for example, placed in the package box) to reduce the occupied space or volume. Alternatively, when the light fixture 100 is mounted on a carrier, the size of the hole in the carrier can be reduced. Details will be described later.

Moreover, the junction box 13 is not tightly connected with the second lid body 14, therefore a space S (referring to FIG. 9) is formed between the junction box 13 and the second lid body 14. Air can flow into the space S through the first groove 141A, the second groove 141B and the third groove 141C to form heat convection and increase heat dissipation. In contrast, air can also flow from the space S to the first groove 141A, the second groove 141B and the third groove 141C.

Referring to FIG. 1B, the second lid 15 (or the light fixture 100) defines a central axis (C) and has a ring-shaped surface 151, a top end 152 (referring to FIG. 4A) and an inner side surface 153 extending from the ring-shaped surface 151 to the top end 152. The inner side surface 153 is an sloped surface and defines a hole 15H. The aperture (D1) of the hole 15H is reduced along the ring-shaped surface 151 toward the top end 152 and a light source module 16 passes through the hole 15H and is surrounded by the inner side surface 153. The inner side surface 153 has a tilt angle (θ) with respect to the central axis and the tilt angle affects the far-field light distribution pattern and the light angle of the light fixture. For example, when the tilt angle is larger, the light distribution pattern and the light angle become larger. Conversely, when the tilt angle is smaller, the light distribution pattern and the light angle become smaller. Furthermore, when the light angle gets larger, the illuminance of the light fixture gets smaller and the light fixture will be prone to glare. For example, assuming two light fixtures (light fixture A and light fixture B) produce the same luminous flux. If the light angle of the light fixture A is greater than that of the light fixture B, the illuminance of the light fixture A will be smaller than that of the light fixture B and the light fixture A will be prone to glare. The tilt angle can be designed so that the light angle of the light fixture 100 is less than 100 degrees, or less than 60 degrees or less than 40 degrees.

Figure 2A:
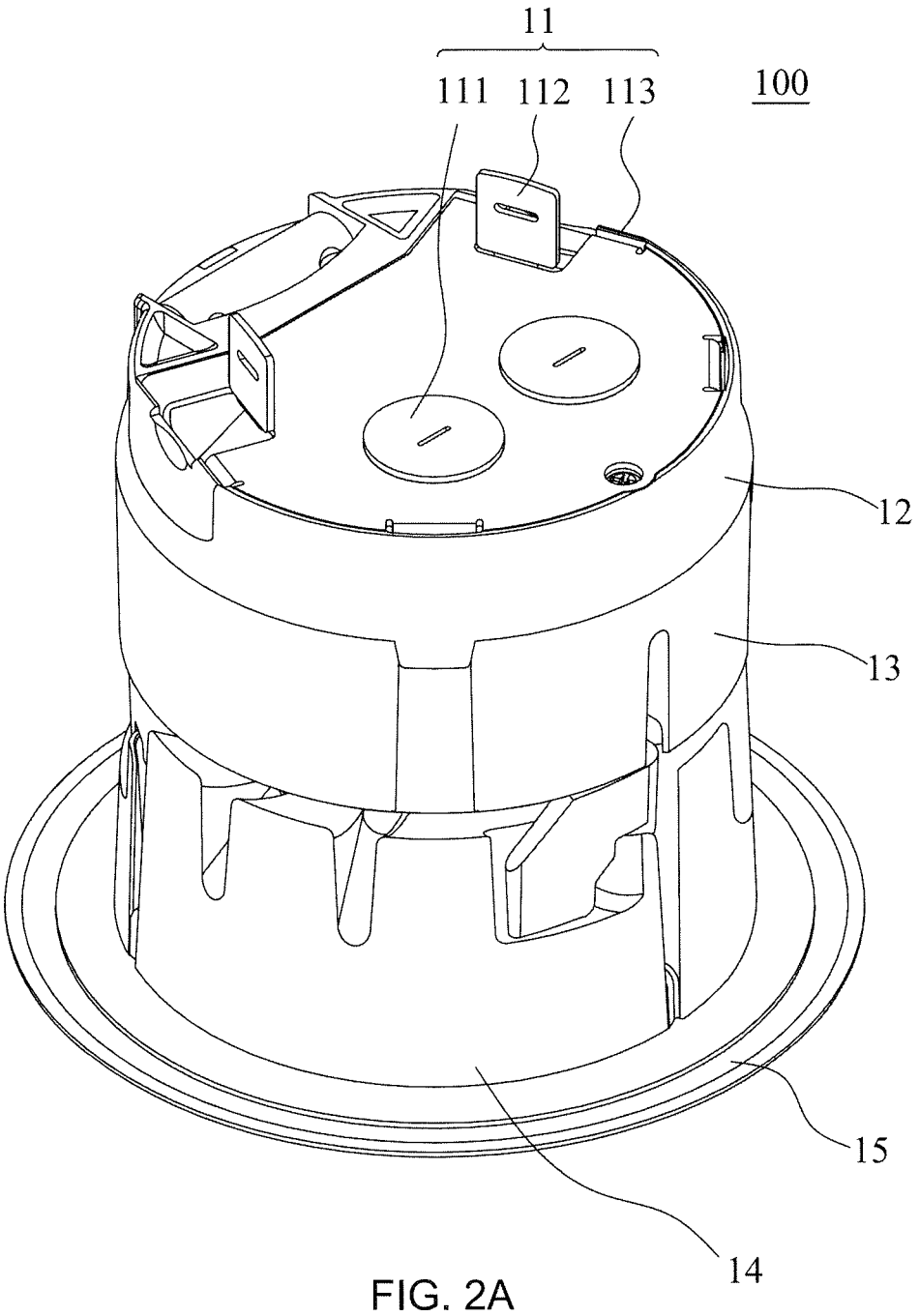
FIG. 2A is another perspective view of a light fixture in an embodiment of the present disclosure.
Figure 2B:
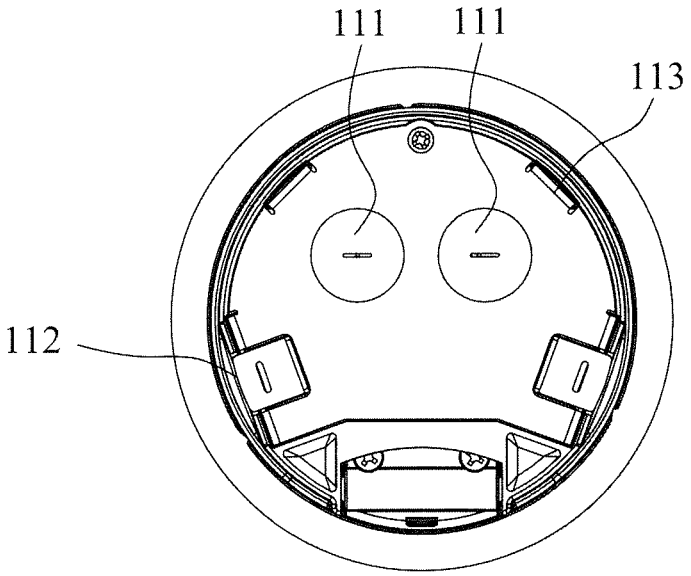
FIG. 2B is a top view of a light fixture in an embodiment of the present disclosure (Pull plate is at a close state).
Figure 2C:
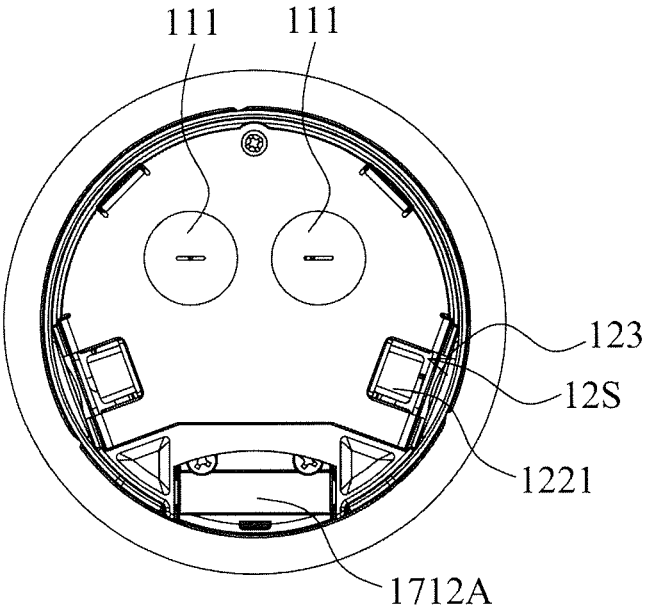
FIG. 2C is a top view of a light fixture in an embodiment of the present disclosure (Pull plate is at an open state).

FIG. 2A shows another perspective view of the light fixture 100 in an embodiment of the present disclosure. The first lid 11 has two circular top plates 111, two pull plates 112 and a plurality of buckles 113. The top plate 111 can be removed so that half-inch or three-quarter inches of metallic flexible conduit or non-metallic conduit pass through the first lid 11 to enter the inside of the junction box 13 and be electrically connected with the connectors 172A-C (referring to FIG. 3A) disposed in the junction box 13. Similarly, the pull plate 112 is rotatable for open so that an external electric cord (wire or cable) (not shown) enters the inside of the junction box 13 and be electrically connected with the connectors 172A-C (referring to FIG. 3A) disposed in the junction box 13. As shown in FIG. 2C, when the pull plate 112 shows an open state, an external electric cord (not shown) can pass through the first lid 11 to enter the inside of the junction box 13 and be electrically connected with the connectors 172A-C (referring to FIG. 3A) disposed in the junction box 13, the details will be described later. FIG. 2B shows the pull plate 112 at a close state. The first lid 11 is fixed to the first lid body 12 by the plurality of buckles 113.

Figure 3A:
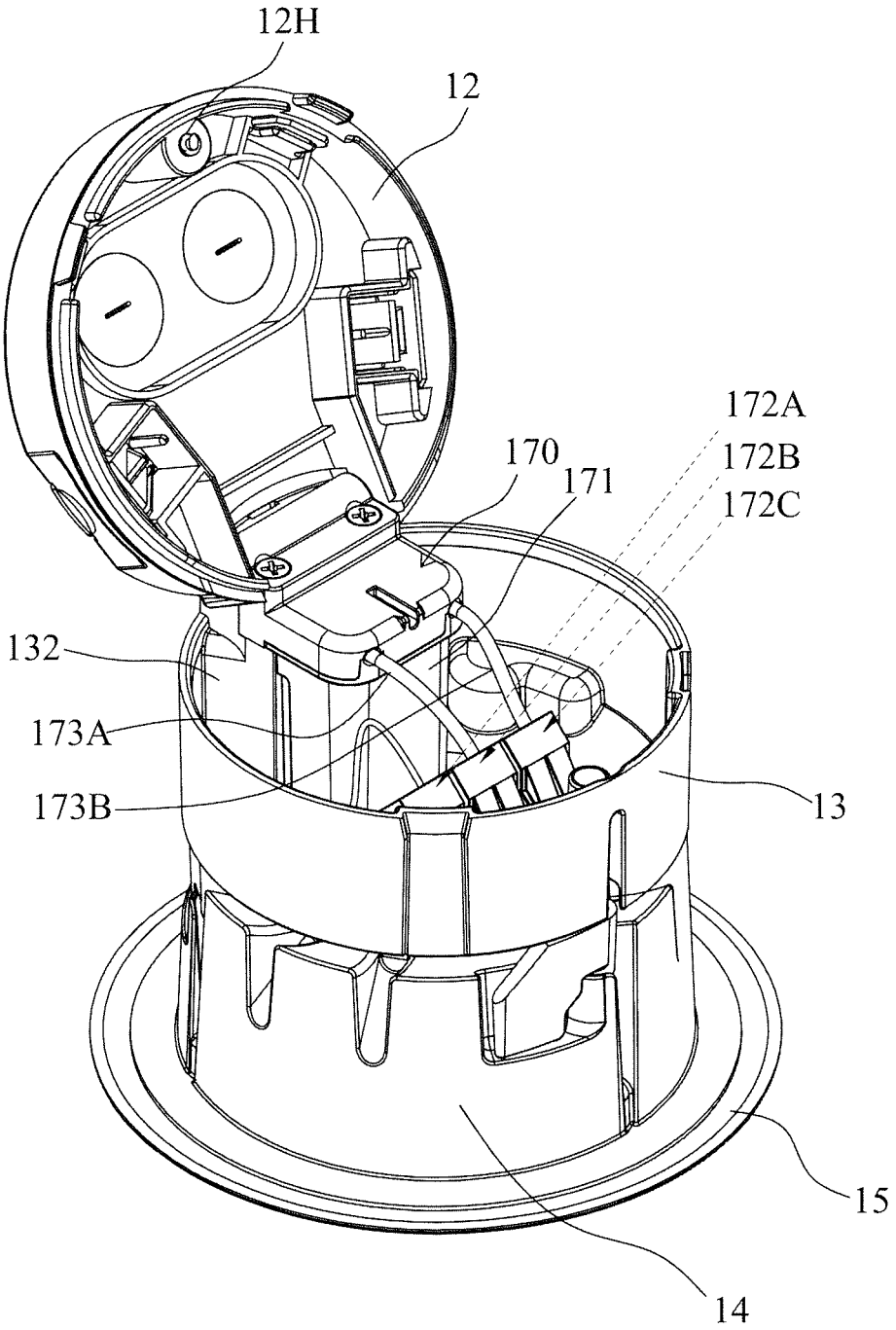
FIG. 3A is another perspective view of a light fixture in an embodiment of the present disclosure.
Figure 3B:
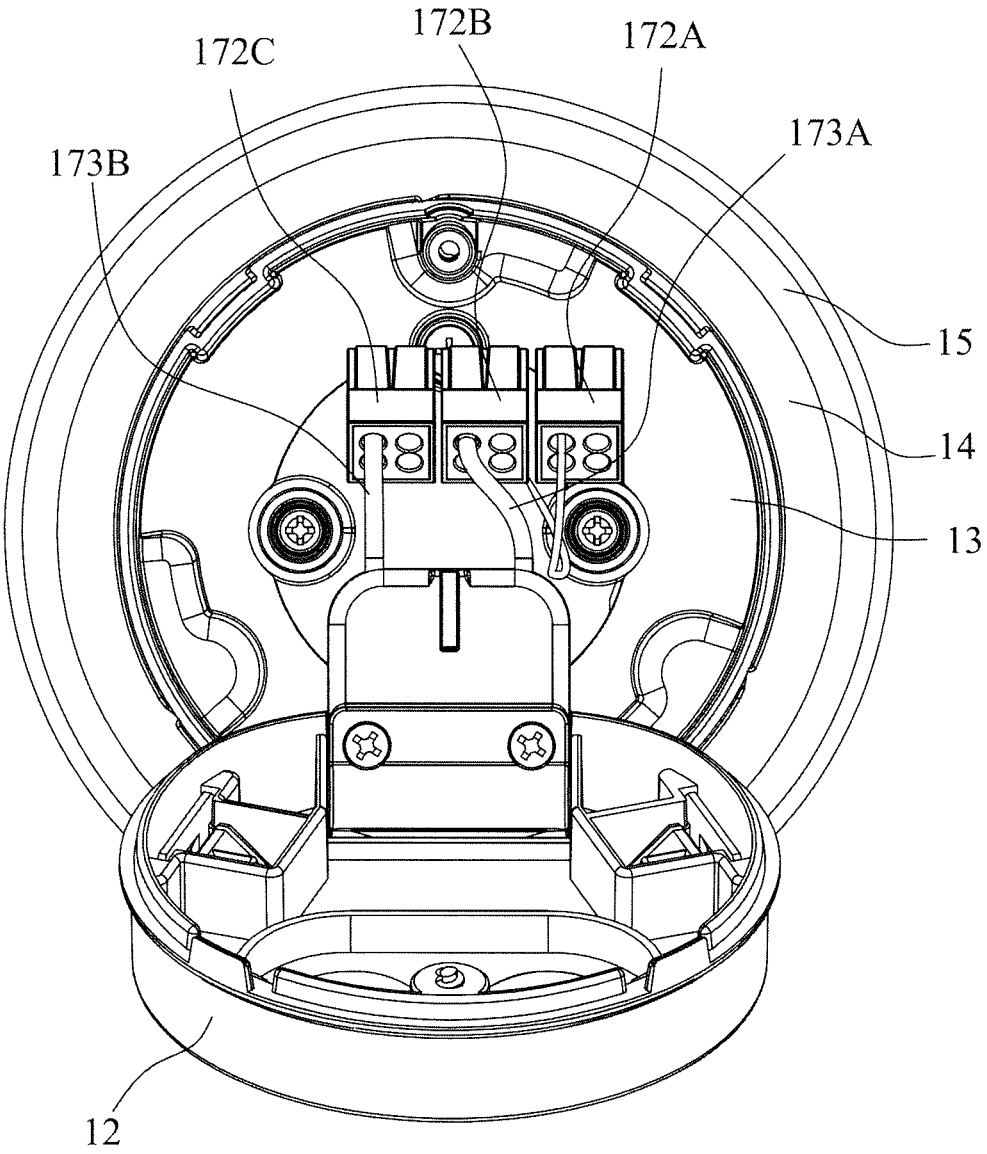
FIG. 3B is a top view of FIG. 3A.

FIG. 3A shows another perspective view of the light fixture 100 in an embodiment of the present disclosure. FIG. 3B shows a top view of FIG. 3A. As shown in FIG. 3A, the first lid body 12 is hinged on the junction box 13 so that the first lid body 12 can be pivoted to show a close state (as shown in FIG. 1A) or an open state (as shown in FIG. 3A). An electronic control module 170 is disposed between the first lid body 12 and the junction box 13, and includes an electronic control box 171. The plurality of connectors 172A-C (for example, product model: WAGO 773 or 221 series) are disposed in the junction box 13. The two electric cords 173A and 173B pass out from the electronic control box 171 and are respectively connected with the connectors 172A and 172B. The connectors 172A-C are not locked on any component (for example, not locked on the electronic control box 171 or the junction box 13). In other words, the connectors 172A-C are freely movable or displaceable within the junction box 13. The electric cords 173A and 173B are a flexible cord and can be flexed or bent. When a plurality of cords are to be electrically connected to each other, the cords can be twisted and wound together, and wound with insulating tape around the cords. However, through the connectors, multiple cords only need to be inserted into the connectors to form an electrical connection without winding procedure.

In FIG. 1A, the junction box 13 has a recess 131. However, as shown in FIG. 3A, the recess 131 is a protruding portion 132 which protrudes toward the inside of the junction box 13. The electronic control box 171 is fixed in the protruding portion 132, and the protruding portion 132 can provide a surface so that the electronic control box 171 can be flatly attached on the surface.

Figure 4A:
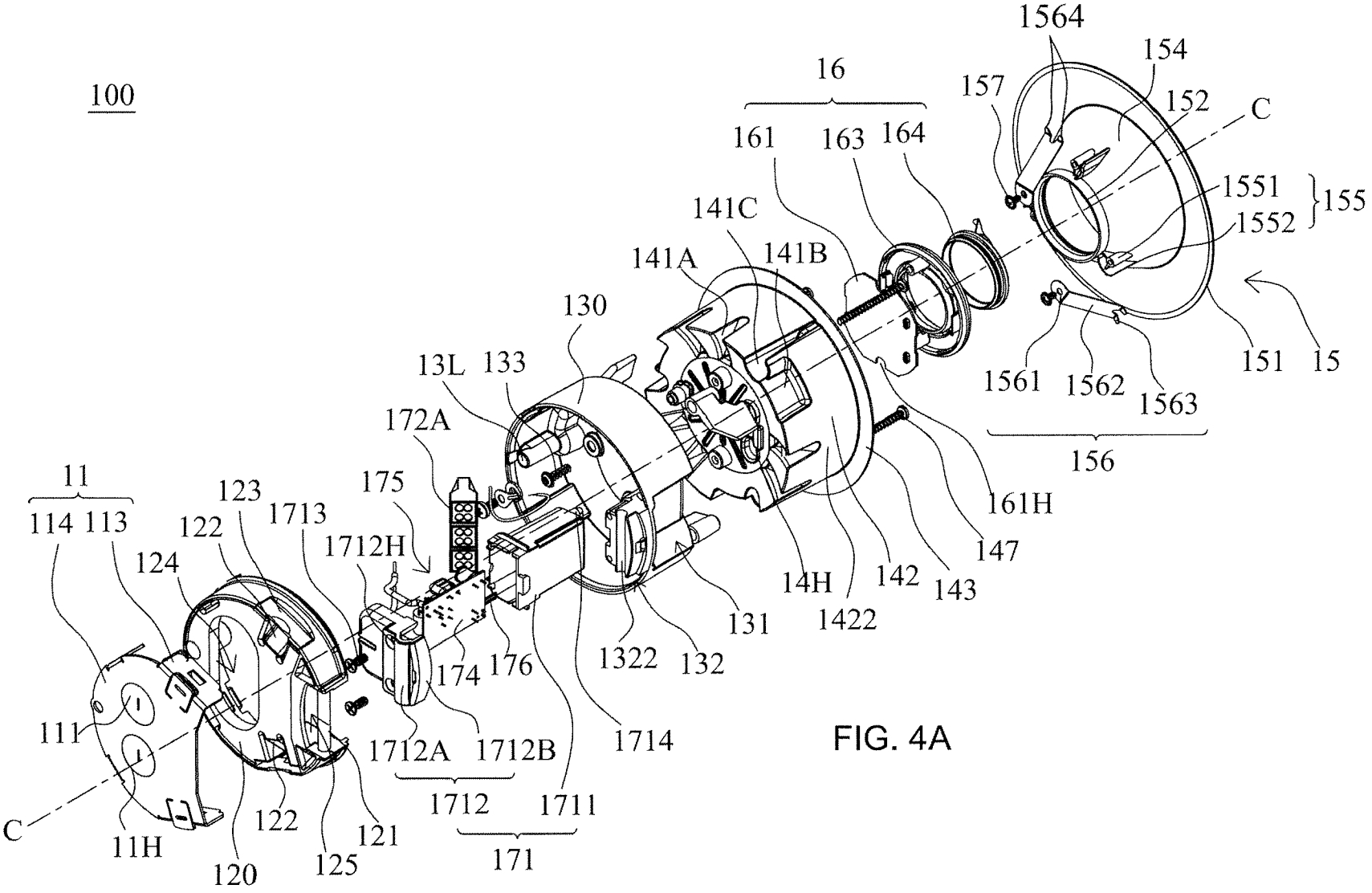
FIG. 4A is an exploded perspective view of a light fixture in an embodiment of the present disclosure.
Figure 4B:
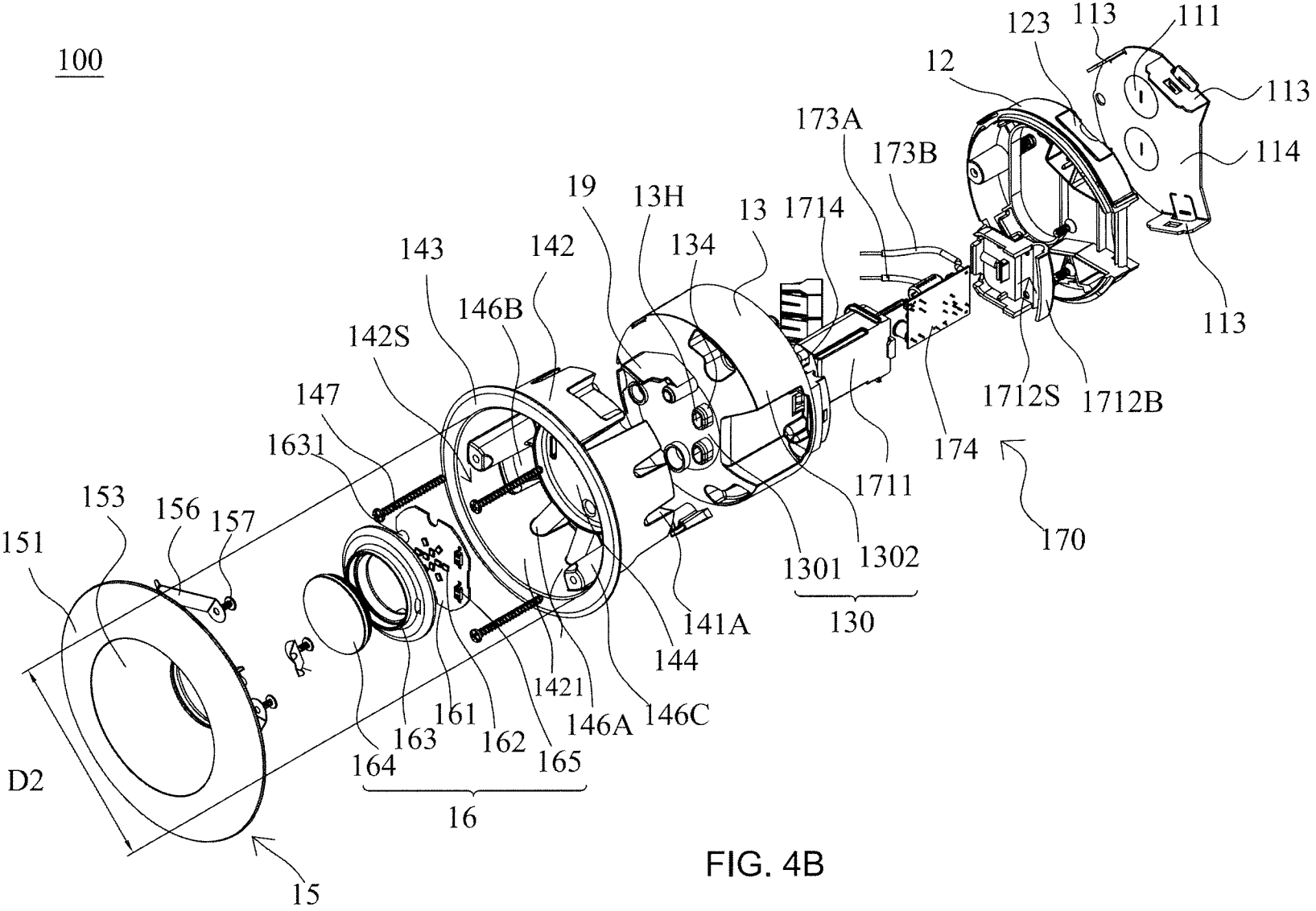
FIG. 4B is another exploded perspective view of a light fixture in an embodiment of the present disclosure.
Figure 4C:
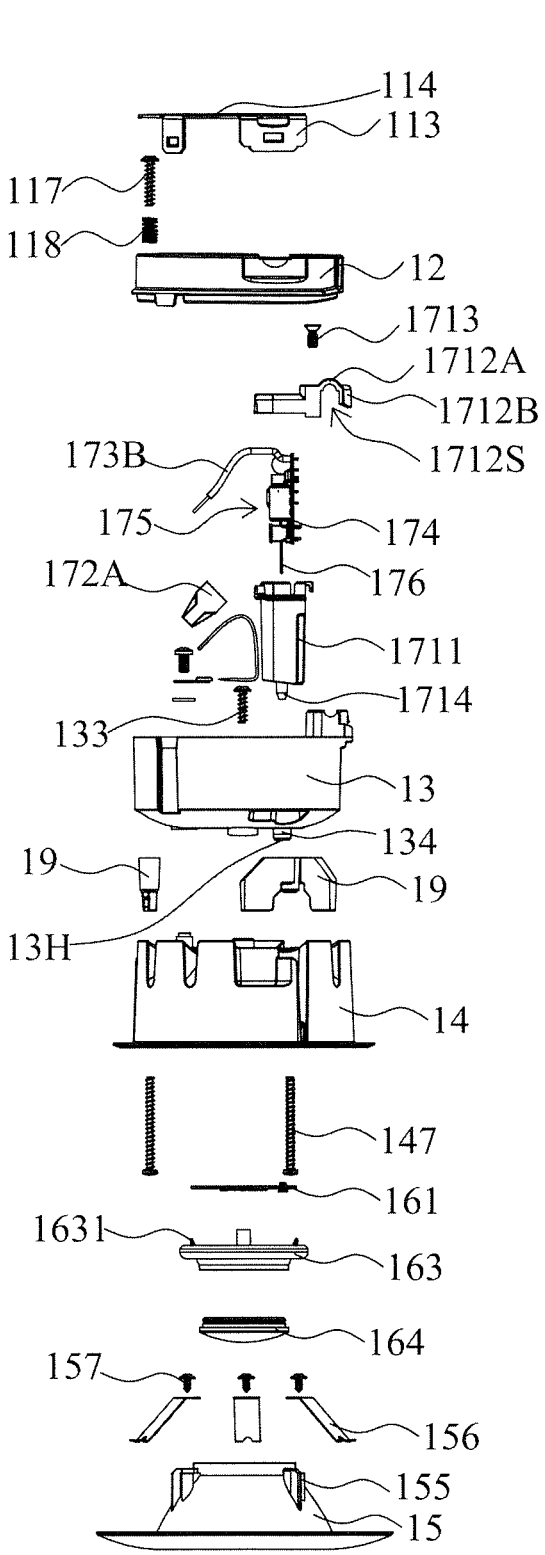
FIG. 4C is an exploded side view of a light fixture in an embodiment of the present disclosure.

FIG. 4A shows an exploded perspective view of the light fixture 100 in an embodiment of the present disclosure. FIG. 4B shows another exploded perspective view of the light fixture 100 in an embodiment of the present disclosure. FIG. 4A and FIG. 4B are exploded perspective views of different views. FIG. 4C shows an exploded side view of the light fixture 100 in an embodiment of the present disclosure.

As shown in FIGS. 4A-4C, the second lid 15 also includes an outer side surface 154 which extends from the surface 151 to the top end 152. Three protrusions 155 are radially equidistantly disposed on the outer side surface 154 and protrude outwardly and are located adjacent to the top end 152 (referring to FIG. 7A). Three elastic components 156 are respectively fixed to the three protrusions 155 by screws 157. The disposition of the elastic component 156 helps to tightly fix the second lid 15 to the second lid body 14 or to easily remove it from the second lid body 14, details will be described later. The position and number of the protrusion 155 and the elastic component 156 can be changed according to actual requirements, but not limited thereto.

A light source assembly 16 includes a carrier 161, a plurality of light emitting structures 162 disposed on the carrier 161, a reflective structure 163 and a light source cover 164. The carrier 161 has two positioning openings 161H formed on the edges to facilitate the assembly of the reflective structure 163 thereon. The reflective structure 163 is disposed on the carrier 161 and surrounds the light emitting structure 162, and has a protrusion 1631 protruding upward. The light source cover 164 is fixed to the reflective structure 163 and may be a mist shell or transparent shell, and can diffuse or homogenize the light emitted from the light emitting structure 162, and prevent the generation of light spots. Two connecting ports 165 are disposed on the carrier 161 and are electrically connected to the light emitting structure 162. Each connecting port 165 has two metal holes 165H (referring to FIG. 8) for circuit pins 176 to pass through and make electrical connection with the circuit pins 176. Details will be described later. The light emitting structure 162 and the connecting port 165 can be fixed on the carrier 161 by surface bonding technique (SMT).

The second lid body 14 has a body 142, a shoulder 143 and a carrier support 144. The shoulder 143 is connected to the body 142 and extends outward from the body 142. The body 142 and the carrier support 144 define an internal space 142S and an aperture (D2) together. The second lid body comprises an inner surface 1421. The first groove 141A, the second groove 141B, and the third groove 141C are formed on an outer surface 1422 of the body 142 and do not penetrate the body 142 and thus are not in communication with the internal space 142S. A first groove 141A, a second groove 141B and a third groove 141C are formed on the outer surface 1422 of the body 142 and do not penetrate the body 142. Therefore the grooves 141A-C are not in communication with the internal space 142S. In another embodiment, the first groove 141A, the second groove 141B and the third groove 141C can penetrate the body 142 and communicate with the internal space 142S to increase heat convection. In addition, the grooves 141A-C in FIG. 1A correspond to the protruding parts 146A-C protruding inward in FIG. 4B. The screw 147 is disposed in the third groove 141C. The fixing component 19 is screwed to the screw 147 through a hole 19H of a first portion 192 (referring to FIG. 6C). The fixing component 19 is used to clamp the light fixture 100 to a carrier (for example, a ceiling or a wall). Details will be described later.

The junction box 13 has a body 130. The body 130 has a bottom portion 1301 and a side portion 1302. Two protruding elements 134 form the bottom portion 1301 and protrude downward, and respectively have two through holes 13H for allowing the protruding lumps 1714 to pass through (detailed structure in FIG. 9). The protruding portion 132 (or the recess 131) is formed on the side portion 1302 of the body 130 and has a groove 1322.

The electronic control module 170 includes the electronic control box 171. A circuit board 174 is disposed in the electronic control box 171. The electric cords 173A and 173B are fixed on the circuit board 174 and are electrically connected with an electronic control component 175 on the circuit board 174. The electronic control component 175 may include a bridge element, a capacitor, a resistor, an inductor, a transformer, or/and an IC to form a Linear circuit or a Switch circuit. The wireless receiving/transmitting module can also be fixed on the circuit board 174. Two circuit pins 176 are formed on the circuit board 174 and are electrically connected with the electronic control component 175, the electric cords 173A-173B and the light emitting structure 162. The connection of the circuit pin 176 and the light emitting structure 162 will be described later.

The electronic control box 171 includes a box body 1711 and a box lid 1712. The box lid 1712 has a hole 1712H. The screw 1713 passes through the hole 1712H to lock the box lid 1712 to the junction box 13. The box lid 1712 has an arc protrusion 1712A and an extension 1712B. The arc protrusion 1712A and the extension 1712B define a space 1712S together. Moreover, when the box lid 1712 is locked on the junction box 13, the arc protrusion 1712A and the groove 1322 form a capacity space for a cylinder 121 of the first lid body 12 to be received and rotated therein. The groove 1322 may have a circular cross-section, a non-circular or square cross-section. If the groove 1322 has a non-circular cross-section, the contact area with the cylinder 121 can be reduced, thereby reducing the resistance of the cylinder 121 when it rotates inward. Other detailed description can be referred to other paragraphs. The box body 1711 has two protruding pieces 1714 protruding downwards and has two holes 17H. Two holes 17H are respectively formed in the two protruding pieces 1714 and penetrate the two protruding pieces 1714 for the circuit pins 176 passing through the protruding pieces 1714 (detailed structure in FIG. 9).

The first lid body 12 has a body 120, a cylinder 121, two slope portions 122, two recesses 123, a first opening 124 and a second opening 125. The first opening 124 is defined by the body 120. The body 120 and the cylinder 121 define the second opening 125 together. During assembling, a part of the cylinder 121 is disposed in the groove 1322 of the protrusion portion 132 of the junction box 13, and the other part is disposed in a space 1712S, whereby the cylinder 121 can be rotated so that the first lid body 12 can be pivoted relative to the junction box 13 to show a close state (FIG. 1A) or an open state (FIG. 3A). In another embodiment, the cylinder 121 can be replaced by two separated circular protrusions. The slope portion 122 has a slope 1221 which is sloped from the inside to the outside and sloped from the top to the bottom, and is separated from the recess 123. Therefore there is a gap 12S between the slope portion 122 and the recess 123 (see FIG. 2C). The slope portion 122 can be made of a material having elasticity.

The first lid 11 has an upper plate 114 and a buckle 113. The upper plate 114 has two round holes 11H. The top plate 111 is disposed in the round hole 11H and the diameter of the top plate 111 substantially matches the aperture of the round hole 11H, so that the top plate 111 completely fills the round hole 11H. During assembling, the upper plate 114 completely covers the first opening 124 and the position of the top plate 111 is disposed relative to the first opening 124. If a metallic flexible conduit or a non-metallic conduit is mounted on the light fixture 100, the top plate 111 can be removed. Next, a metallic flexible conduit or a non-metallic conduit can pass through the round hole 11H and the first opening 124 and into the junction box 13. Since the space inside the junction box 13 is limited and when the diameter of the external cord is large, the external cord cannot be freely moved within the junction box 13.

The buckle 113 extends downward from the edge of the upper plate 114, and engages with the recess 123 of the first lid body 12 during assembling. The pull plate 112 is disposed on the upper plate 114 and extends outward to exceed the edge of the upper plate 114, so that the pull plate 112 can be opened or closed by an external force(for example, a hand or a wrench). During assembling, the position of the pull plate 112 is relative to the slope portion 122 and covers the slope portion 122. At this time, the pull plate 112 shows a close state (see FIG. 2B). When the pull plate 112 is in an open state (as shown in FIG. 2C), an external cord (cable or wire) can pass through the gap 12S from the outside to enter into the junction box 13 and the external cord (cable or wire) can be fixed in the gap 12S. In addition, the external cord (cable or wire) can easily enter the junction box 13 along the slope 1221 by the slope design of the two slope portions 122. When the external cord is pulled out in the opposite direction, since the slope portion 122 has elasticity, a portion of the slope portion 122 may be bent to catch the external cord so that the external cord is difficult to be pulled out. In addition, because of the slope design of the elastic slope portion and the diameter of the external cord is large so that the external cord is not easy to be bent, the external cord cannot be freely moved in the junction box 13.

As described above, the movement position of the external cord within the junction box 13 is limited due to the limitations of the slope, the space, and the cord diameter. Therefore, the free movement of the connectors 172A-C and the bendable design of the electric cords 173A-B allow the connectors 172A-C and the electric cords 173A-B to move in accordance with the position of the external cords. As a result, the external cords can be easily connected with the connectors 172A-C to reduce the difficulty of assembly.

Figure 5A:
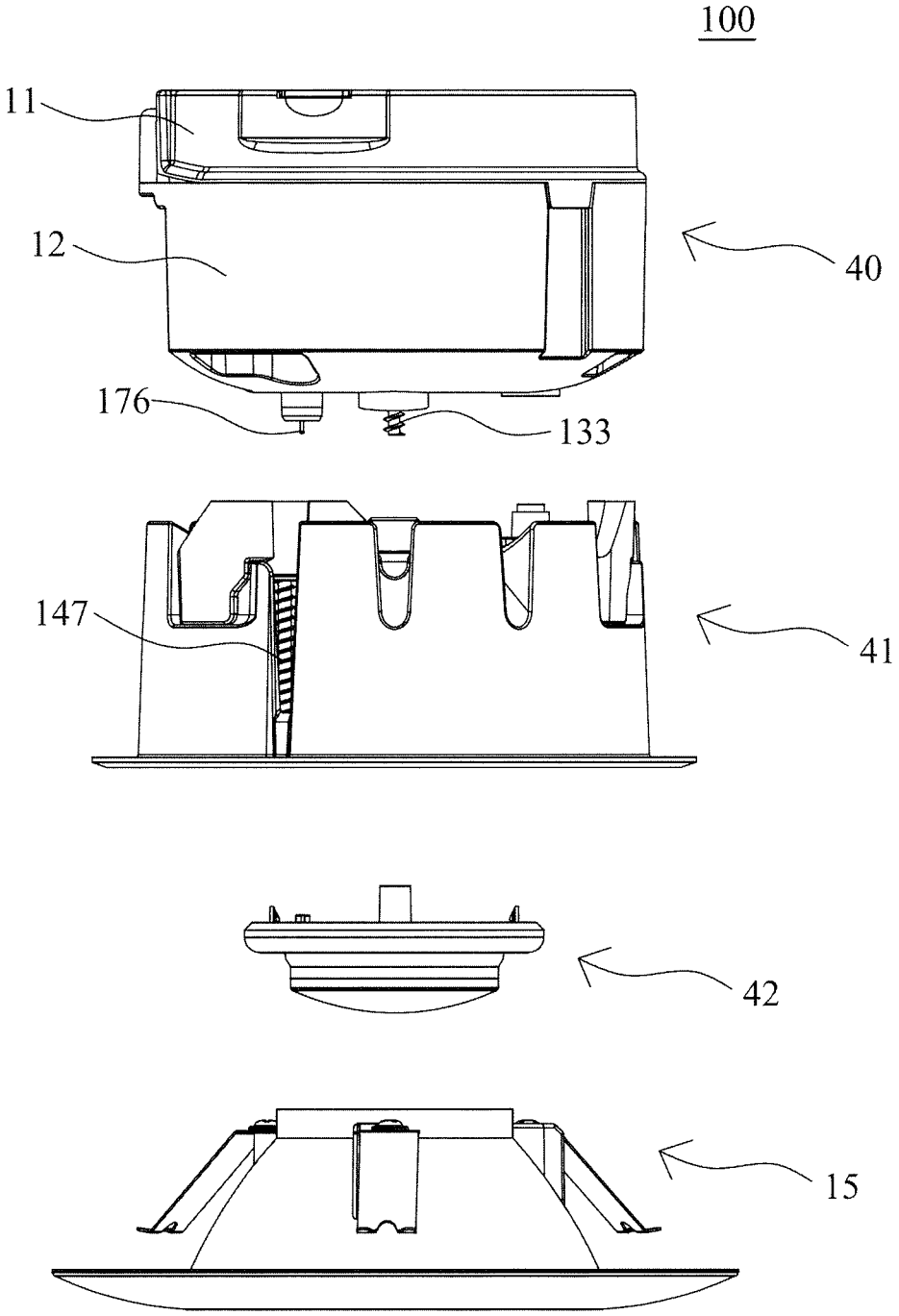
FIG. 5A is a side view of a part assembly of a light fixture in an embodiment of the present disclosure.
Figure 5B:
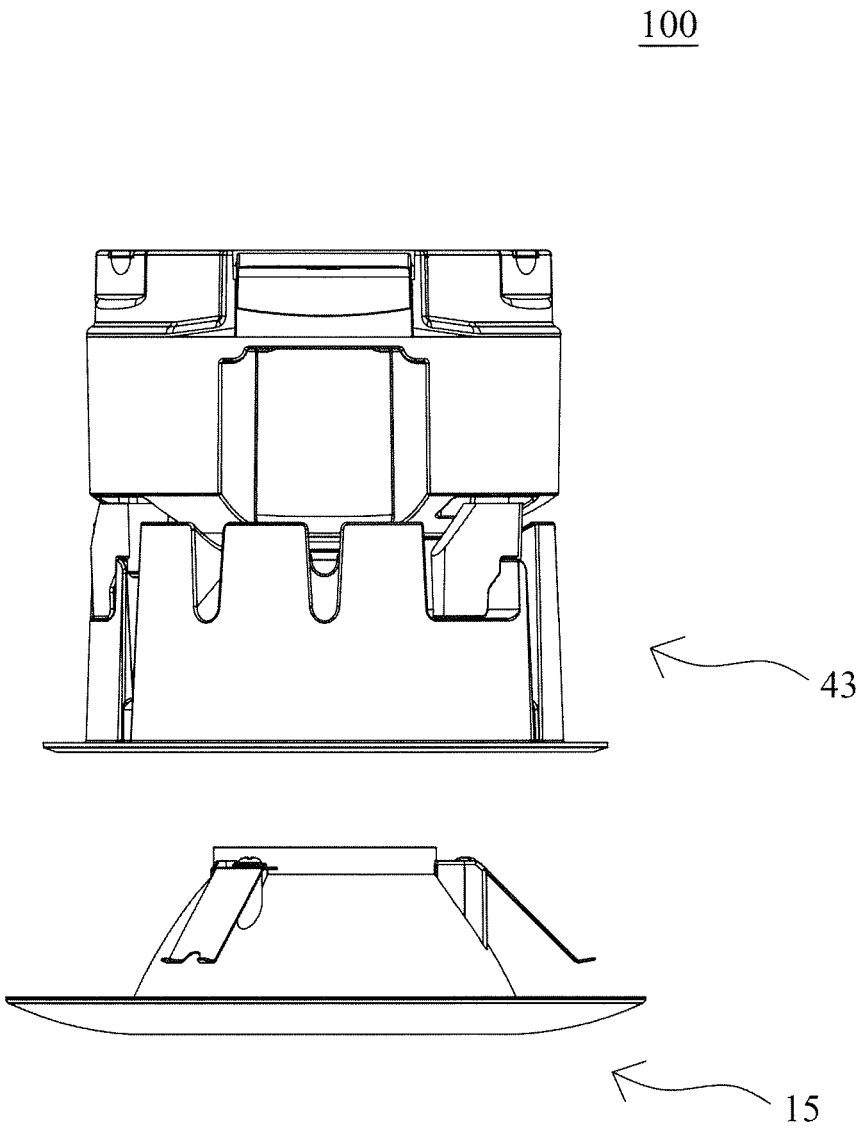
FIG. 5B is a side view of a part assembly of a light fixture in an embodiment of the present disclosure.

FIG. 5A and FIG. 5B show a side view of a part assembly of the light fixture 100 in an embodiment of the present disclosure. FIG. 5A and FIG. 5B will describe the assembly flow of the light fixture 100. Referring to FIG. 4A, FIG. 4B, FIG. 4C and FIG. 5A, during assembling, the first lid 11 is engaged to the first lid body 12. At this moment, the buckle 113 is disposed in the recess 123 and the upper plate 114 completely covers the first opening 124. The position of the top plate 111 is located at the position of the first opening 124. The pull plate 112 is located on the slope portion 122 and the second opening 125 is not covered by the upper plate 114.

The circuit board 174 having the electronic control component 175, the electric cords 173A-B and the circuit pins 176 is disposed in the box body 1711. At this time, the circuit pins 176 penetrate the protruding pieces 1714 and expose a portion thereof. Electric cords 173A and 173B are respectively connected to two of the connectors 172A-C. Next, the body box 1711 is attached and fixed on the surface of the protrusion portion 132. At this time, the circuit pin 176*s* also penetrate the hole 13H of the protruding elements 134 and are exposed (as shown in FIG. 5A).

After the cylinder 121 of the first lid body 12 is disposed in the space 1712S, the first lid body 12 and the box lid 1712 are combined. The second opening 125 exposes the arc protrusion 1712A.

After that, the cylinder 121 of the first lid body 12 is disposed in the groove 1322 and the box lid 1712 and the box body 1711 is engaged with each other. The box lid 1712 is locked on the junction box 13 by the screws 1713. Then, the first lid body 12 and the junction box 13 are locked by the screw 117 to complete the first assembly 40. A spring 118 is provided to sleeve the screw 117 for creating a spring force, so that the screw 117 can be substantially fixed in a position. In detail, when the first lid body 12 has to be rotated relative to the junction box 13 to show an open state, the screw 117 needs to be loosened. After loosening the screw 117, if there is no spring 118, the screw 117 will naturally fall down and get stuck at the bottom of the hole 12H (referring to FIG. 3A) (Because the nut is larger than the aperture of the hole 12H). When the first lid body 12 has to be rotated again and closed with the junction box 13, the screw 117 cannot be accurately aligned with the hole 13L of the junction box 13 and the screw 117 needs to be further moved to align with the hole 13L, thereby causing difficulties of assembly. In contrast, if a spring 18 is provided to sleeve the screw 117, when the screw 117 is loosened, the screw 117 will remain in a substantially constant position in the hole 12H because of the spring force provided by the spring 118 (The screw 117 will not shift to the bottom of hole 12H). Thus when the first lid body 12 is further rotated again to close with the junction box 13, the screw 117 can be accurately aligned with the hole 13L of the junction box 13.

Referring to FIGS. 4A, 4B and 5A, the carrier 161 having the plurality of light emitting structures 162 is engaged with the carrier support 144 of the second lid body 14 and the connecting port 165 is aligned with the hole 14H of the second lid body 14. The screw 147 is disposed in the third groove 141C and the fixing component 19 is screwed onto the screw 147 to complete a second assembly 41.

Referring to FIGS. 4A, 4B and 5A, the reflective structure 163 and the light source cover 164 are engaged by using an ultrasonic bonding technique or using an adhesive, a fastener, or the like to complete a third assembly 42.

Referring to FIGS. 4A, 4B, 5A and 5B, the circuit pins 176 exposed from the lower portion of the junction box 13 are aligned with the connecting ports 165 on the carrier 161, and the circuit pins 176 are inserted into the connecting port 165 to assemble the first assembly 40 and the second assembly 41. The protrusion 1631 of the reflective structure 163 is aligned with the positioning opening 161H of the carrier. Finally, a screw 133 is provided to lock the junction box 13, the second lid body 14 and the third assembly 42 to complete a fourth assembly 43.

When the carrier 161 is assembled to the second lid body 14, the position of the connecting port 165 will be a certain distance from the body 142. In order to align the circuit pin 176 with the connecting port 165, the electronic control box 171 (including the circuit board 174) needs to be disposed in a distance from the body 130. Therefore, when the electronic control box 171 is fixed on the junction box 13, the position of the electronic control box 171 can make the circuit pin 176 aligned with the connecting port 165 by the design of the protruding portion 132 of the junction box 13. Besides, the design of the protruding portion 132 (forming the recess 131) can also reduce the manufacturing material of the junction box 13, so as to reduce the manufacturing cost. In another embodiment, the junction box 13 may not have the protruding portion 132 that means the recess 131 is not formed. The electronic control box 171 is fixed to the junction box 13 by the inward extension of the frame or rib, so that the circuit pin 176 is aligned with connecting port 165.

Figure 6A:
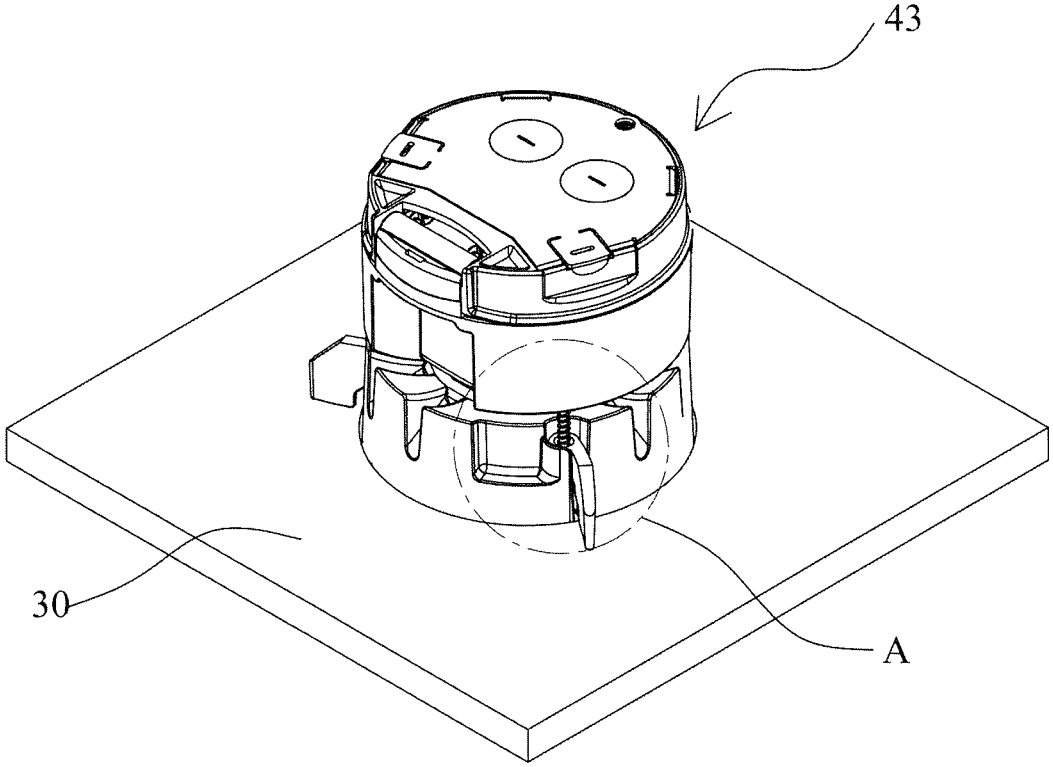
FIG. 6A is a perspective view of a light fixture fixed to a carrier in an embodiment of the present disclosure.
Figure 6B:
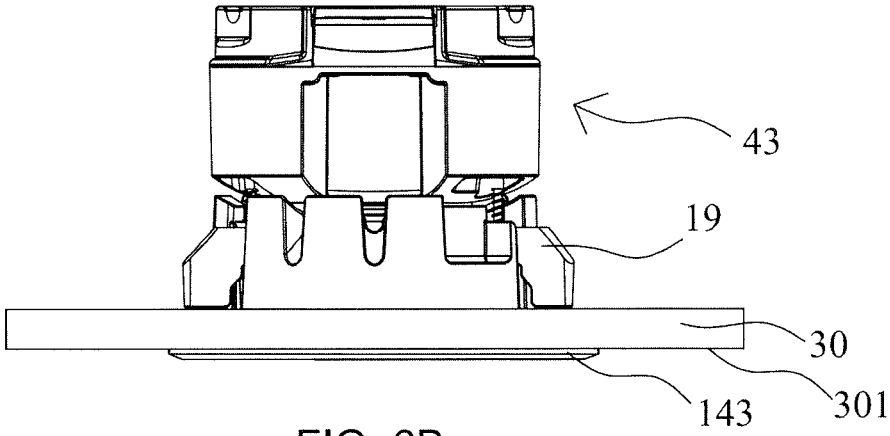
FIG. 6B is a side view of a light fixture fixed to a carrier in an embodiment of the present disclosure.
Figure 6C:
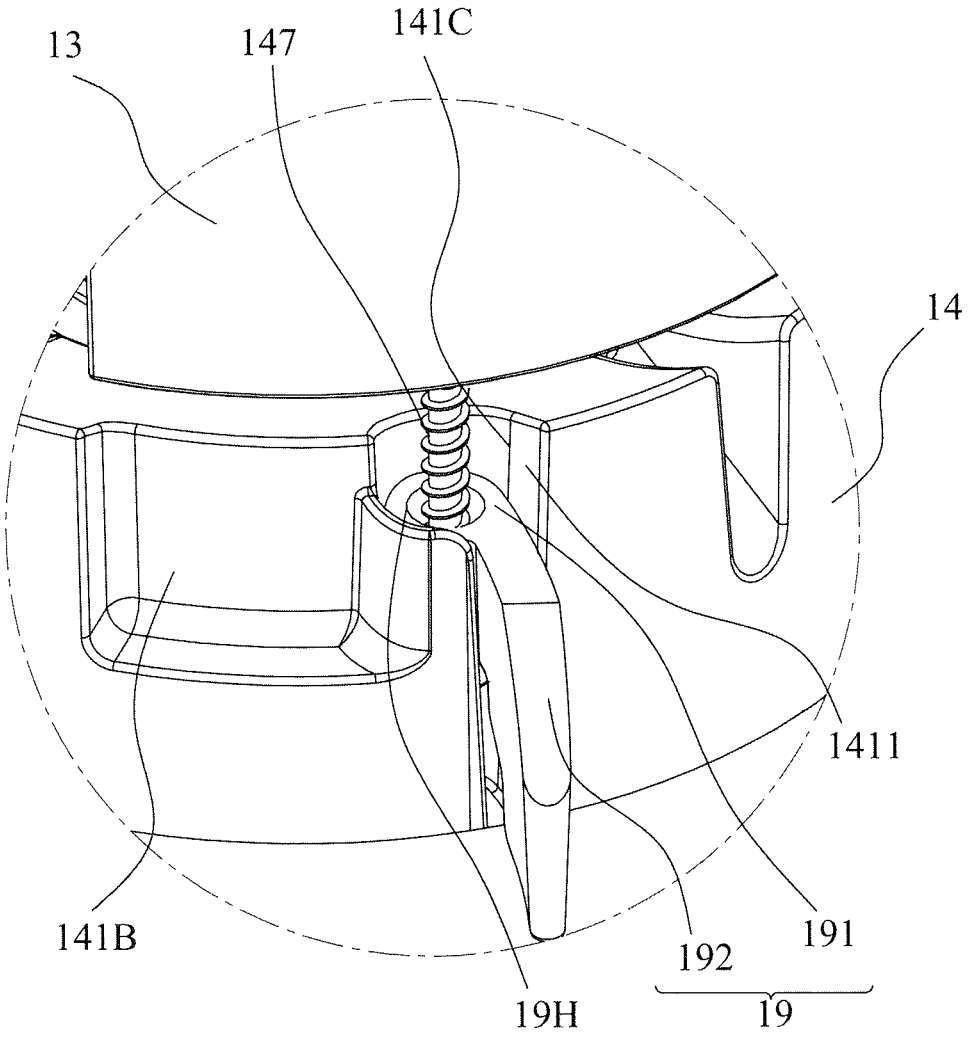
FIG. 6C is an enlarged view of a circle A of FIG. 6A

FIG. 6A shows a perspective view of the fourth assembly 43 fixed to a carrier 30 (for example, a ceiling) in an embodiment of the present disclosure. FIG. 6B shows a side view of the fourth assembly 43 fixed to the carrier 30 in an embodiment of the present disclosure. FIG. 6C is an enlarged view of a circle A of FIG. 6A. Referring to FIGS. 4A, 4B and 6A to 6C, the fourth assembly 43 is passed through the opening of the carrier 30. At this time, the first portion 191 of the fixing component 19 is screwed onto the screw 147 and the second portion 192 is located in the second groove 141B (as shown in FIG. 1A), and the shoulder 143 is exposed and abutted against the bottom surface 301 of the carrier 30. That is, the carrier 30 is located between the shoulder 143 and the fixing component 19. If the fixing component 19 is not disposed in the second groove 141B and is in an open state, the fixing component 19 will be gotten stuck in the opening, and the subsequent installation procedure cannot be continued. If the fixing component 19 is to be opened and can pass through the opening, the opening needs to be enlarged. Therefore, the second portion 192 of the fixing component 19 located in the second groove 141B can reduce the overall volume and reduce the opening size of the carrier.

Next, when the screw 147 is rotated clockwise (viewed from the bottom to the top), in the meantime the second portion 192 is rotated clockwise and away from the second groove 141B to touch the third groove wall 1411. At this time, the fixing component 19 shows an open state. When the screw 147 is continuously rotated clockwise, the second portion 192 is not continuously rotated (due to the disposition of the third groove wall 1411) but is moved downward (moved in the direction to the carrier 30). When the second portion 192 is lowered to contact the carrier 30, the rotation can be continued to abut against or fasten the second portion 192 on the carrier 30. Finally, the second lid 15(not shown in FIG. 6A) is loaded to complete the assembly of the light fixture 100.

Figure 7A:
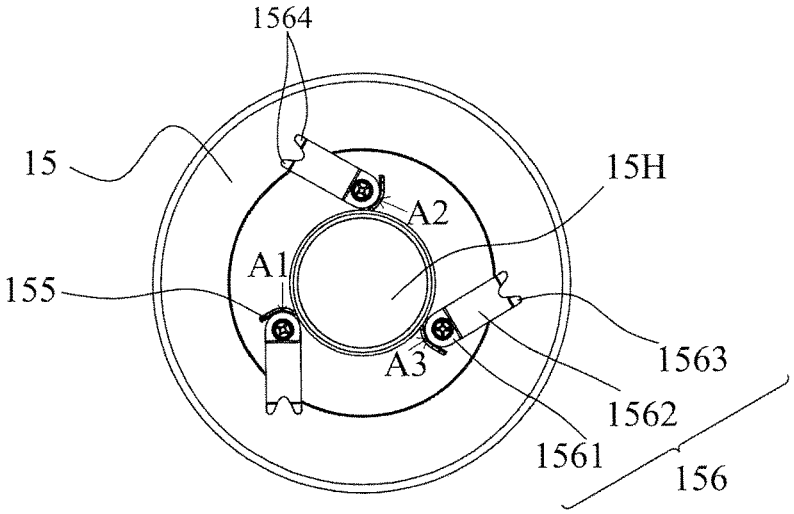
FIG. 7A is a top view of a second lid in an embodiment of the present disclosure.
Figure 7B:
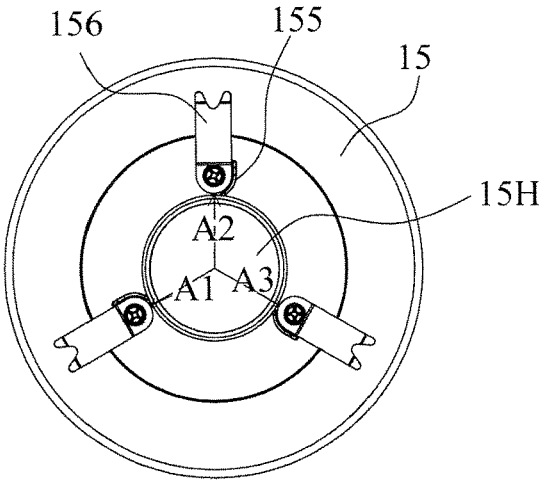
FIG. 7B is a top view of a second lid in an embodiment of the present disclosure.

FIG. 7A is a top view of the second lid 15. Referring to FIGS. 4A and 7A, a protrusion 155 includes a cylinder 1551 and a baffle 1552. There is a gap between the cylinder 1551 and the baffle 1552 for the rotation of the elastic component 156. Each of the three baffles 1552 is located on the same side (It can be left or right side of the corresponding cylinder 1551 and be the left side in present embodiment). When the elastic component 156 is rotated clockwise as shown in FIG. 7B (viewed from top to bottom), the elastic component 156 is blocked by the baffle 1552 and cannot be further rotated. In contrast, the elastic component 156 can be rotated counterclockwise until it touches the outer side surface 154. The degree of freedom for the rotation of the elastic member 156 in the clockwise direction (first rotation direction) is smaller than the degree of freedom for the rotation in the counterclockwise direction (second rotation direction).

Referring to FIGS. 4A and 7A, the elastic component 156 has a top portion 1561, an extending portion 1562 and a bottom portion 1563. The top portion 1561 is rotated to be fixed to the cylinder 1551. The extending portion 1562 extends obliquely downward from the top portion 1561. The bottom portion 1563 extends outward from the extending portion 1562. The extending direction of the extending portion 1562 is different from the extending direction of the bottom portion 1563 (not perpendicular to each other). The bottom portion 1563 comprises one or more teeth 1564. In the present embodiment, the bottom portion 1563 comprises two teeth 1564; in other embodiments, the bottom portion 1563 comprises teeth 1564 greater or fewer than two.

As shown in FIG. 7A, the three vertices A1, A2, A3 of the three elastic components 156 are oriented in different directions rather than toward the hole 15H. Three elastic components 156 are rotated to make the three vertices A1, A2, A3 toward the holes 15H slowly. Finally, as shown in FIG. 7B, the three vertices A1, A2, A3 of the three elastic components 156 are substantially oriented the center of the hole 15H.

When the second lid 15 and the second lid body 14 are assembled, the elastic component 156 is abutted against on the baffle 1552 first (as shown in FIG. 7B). Then, the second lid 15 is aligned with the second lid body 14 and the extending portion 1562 is overlapped and contacted with the shoulder 143. Apply a force to insert the second lid 15 into the second lid body 14 to complete the assembly. At this time, the extending portion 1562 is bent, and the extending portion 1562 and the bottom portion 1563 are in contact with the inner surface 1421 of the second lid body 14. Furthermore, the teeth 1564 of the bottom portion 1563 can engage with the inner surface 1421 and the bottom portion 1563 is locked to the inner surface 1421 (a frictional force is generated) so that the second lid 15 will not drop. In order to remove the second lid 15, the second lid 15 can be rotated counterclockwise to rotate the elastic component 156 to a position as shown in FIG. 7A. When the elastic component 156 is rotated and moved, the extending portion 1562 and the bottom portion 1563 are no longer in contact with the inner surface 1421 (or the contact area between the inner surface 1421 and the extending portion 1562, the bottom portion 1563 becomes smaller). The locking force (friction) between the elastic component 156 and the second lid body 14 is also disappeared accordingly. Therefore the second lid 15 can be easily taken out and removed.

The assembly of the light fixture 100 is not limited to the above-mentioned. In an embodiment, the carrier 161 can be assembled on the second lid 14 first. Then, after assembling the junction box 13 on the second lid body 14, the box body 1711 (including the circuit board 174 having the electronic control component 175, the electric cords 173A, 173B and the circuit pins 176) is assembled on the junction box 13 to make the circuit pins 176 plugged in the connecting ports 165. Finally, the box lid 1712, the first lid body 12 and the first lid 11 are assembled.

The first lid 11 may be a metal plate (for example, a low carbon steel plate, a stainless steel plate, a galvanized steel plate or an aluminum plate) or a plastic plate. The first lid 11 and the top plate 111 may be formed by the punch method. The material of the first lid body 12 may be plastic (for example, PA (Polyamide), PC (Polycarbonate), or ABS (Acrylonitrile Butadiene Styrene). The material of the junction box 13 may be metal or plastic (for example, PA (Polyamide), PC (Polycarbonate), or ABS (Acrylonitrile Butadiene Styrene). The material of the second lid body 14 may be metal (for example, aluminum, steel, copper, iron) or plastic (for example, PA (Polyamide), PC (Polycarbonate), ABS (Acrylonitrile Butadiene Styrene), PBT (Polybutylene terephthalate) and can be used as a heat sink. The material of the second lid 15 may be metal or plastic (for example, PA (Polyamide), PC (Polycarbonate), or ABS (Acrylonitrile Butadiene Styrene). The material of the elastic component 156 may be plastic (for example, PA (Polyamide), POM (Polyoxymethylene) or metal (for example, low carbon steel, high carbon steel, stainless steel). The material of the reflective structure 163 may be PC (Polycarbonate) or ABS (Acrylonitrile Butadiene Styrene) and may achieve a V0 fire-protection rating in UL94. The carrier 161 may be a printed circuit board. The material of the light source cover 164 may be PC (Polycarbonate) or ABS (Acrylonitrile Butadiene Styrene). The fixing component 19 may be metal (for example, aluminum, steel, copper, iron) or plastic (for example, PA (polyamide), PC (Polycarbonate), or ABS (Acrylonitrile Butadiene Styrene). All the above-mentioned plastic materials can achieve V0 fire-protection rating in UL94. Alternatively, thermal materials such as graphite, ceramic powder, and/or carbon nanotubes may be doped into the above-mentioned plastic material to form thermally conductive plastic.

The screw is used for joint in the present disclosure. However, bolts, studs, nuts, or other suitable fasteners may also be used for joint.

Figure 8:
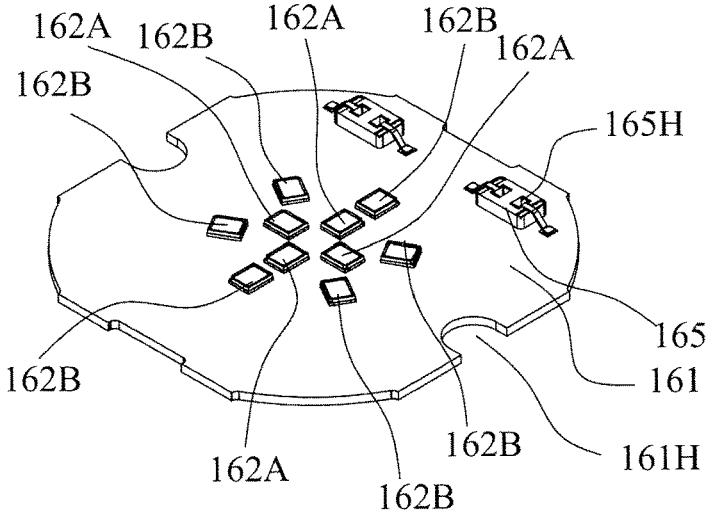
FIG. 8 is a perspective view of a carrier plate in an embodiment of the present disclosure.

As shown in FIG. 8, the light emitting structure 162 includes a first light emitting group 162A and a second light emitting group 162B. In this embodiment, the first light emitting group 162A includes four light emitting units and the second light emitting group 162B includes six light emitting units. The second light emitting group 162B is disposed at outside of the first light emitting group 162A and surrounds the first light emitting group 162A. The number and arrangement of the first light emitting group 162A and the second light emitting group 162B can be changed according to the actual requirements, but not limited thereto. The first light emitting group 162A and the second light emitting group 162B may emit the same color light or different color light. For example, the first light emitting group 162A emits red light and the second light emitting group 162B emits blue light. Optionally, the first light emitting group 162A and the second light emitting group 162B may emit white light and may have the same color temperature (for example, the first light emitting group 162A and the second light emitting group 162B emit warm white light (2200 K to 4000 K) or cool white light (4000K~6500K) or different color temperature (for example, the first light emitting group 162A emits warm white light (2200K~4000K) and the second light emitting group 162B emits cool white light (4000K~6500K); or the first light emitting group 162A emits warm white light (2200K to 4000K, for example, 2700K) and the second light emitting group 162B also emits warm white light (2200K to 4000K, for example, 3000K).

The light emitting unit may include a package structure. A light emitting chip is fixed in the package structure and a transparent glue cover the light emitting chip. When the transparent glue contains wavelength conversion particles, the wavelength conversion particles can convert the first light emitted by the light emitting chip into a second light. The first light and the second light can be mixed to form a white light. The light emitting chip may include a growth substrate, a first type semiconductor layer, an active layer, a second type semiconductor layer and two electrodes.

As shown in FIG. 8, two connecting ports 165 are disposed on the carrier plate 161. In this embodiment, two circuit pins 176 are disposed on the circuit board 174 and are only electrically connected with one connecting port 165 to provide power to the light emitting structure 162 (another connecting port 165 is not electrically connected with the circuit board). Through the design of the electronic control component 175, the light emitting units can be connected in parallel or in series, and all the light emitting units can emit light at the same time or not at the same time.

Alternatively, four circuit pins can be provided on the circuit board 174 to respectively form electrical connections with two connecting ports 165 (two circuit pins disposed on one connection port), so that the first light emitting group 162A and the second light emitting group 162B (dual channel) can be respectively controlled. The number of circuit pins and connecting ports can be changed according to actual requirements, but not limited thereto.

Figure 9:
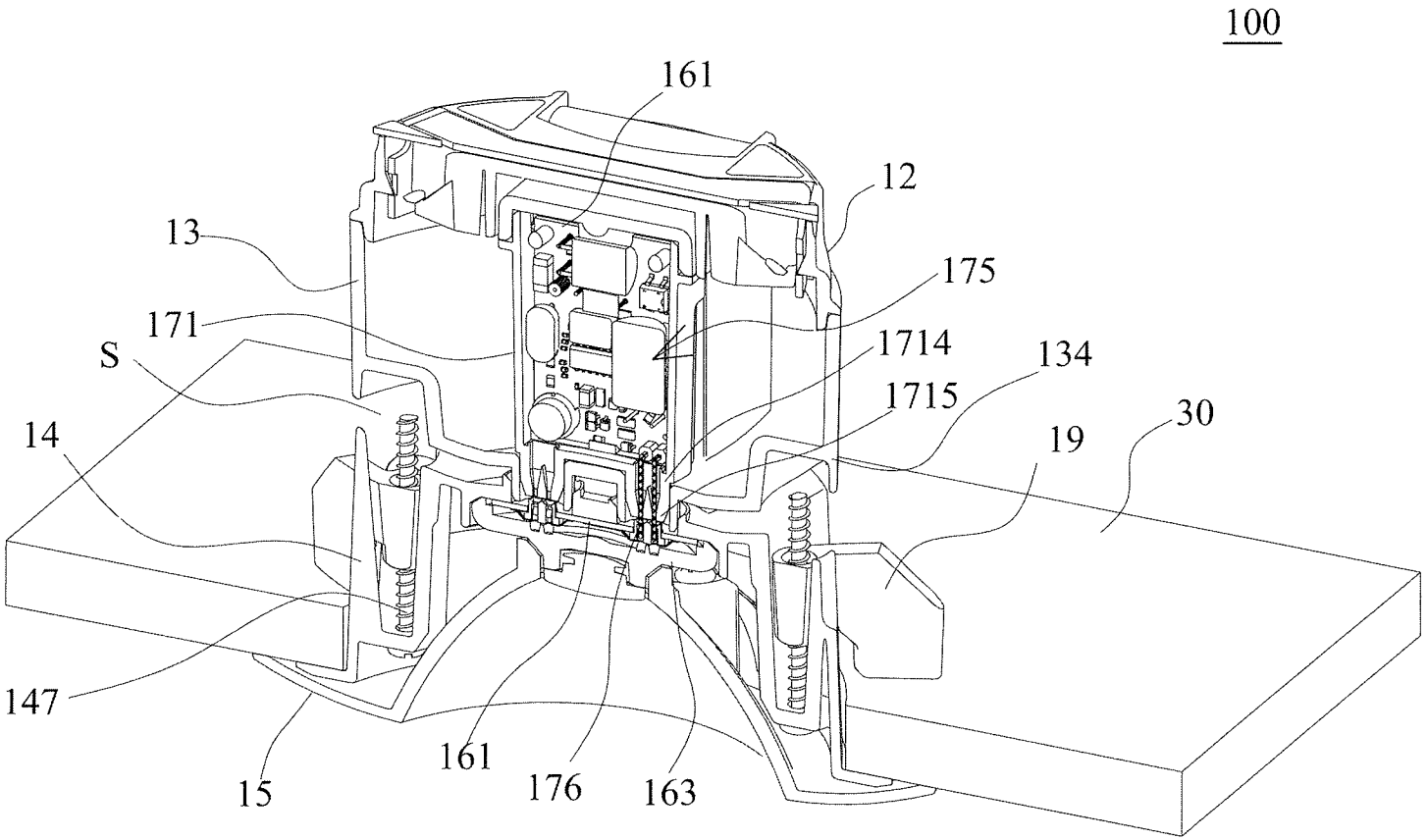
FIG. 9 is a cross-sectional view of a light fixture fixed to a carrier in an embodiment of the present disclosure.

FIG. 9 shows a cross-sectional view of the light fixture 100 in an embodiment of the present disclosure. The circuit pin 176 is an L-shape and passes through the electronic control box 171, the junction box 13 and the second lid body 14 to be inserted into the connecting port 165 on the carrier 161. The protruding piece 1714 surrounds the circuit pin 176. The protruding element 134 surrounds the protruding piece 1714 and the circuit pin 176. Through the protruding piece 1714 and the protruding element 134, the circuit pin 176 and the second lid body 14 can be separated by a sufficient distance to avoid arcing. The protruding piece 1714 and the protruding element 134 are made of plastic material and can also avoid flashover. Furthermore, the bottom of the protruding piece 1714 has a chamfered inclined structure 1715 to facilitate the assembly with the protruding element 134. Other related descriptions can be referred to other paragraphs.

When the light emitting structure 162 emits light, the light emitted from the light emitting structure 162 passes through the light source cover 164 and is emitted outward through the second lid 15. The heat generated by the light emitting structure 162 can be transferred to the carrier 162, the second lid body 14, the second lid 15 and heat exchange is performed with the external environment.

A temperature measurement can be performed to measure the temperature of the carrier 162. The temperature measurement steps are as follows:

Step 1: Provide a wooden box (length*width*height=56 cm*56 cm*35 cm) and dig a hole in the bottom (the size of the hole is set according to the maximum aperture of the second lid body 14. In this embodiment, the maximum aperture of the second lid body 14 is 4 inches);

Step 2: The light fixture 100 is passed through the hole and disposed in the wooden box, and only the second lid 15 is exposed to the external environment;

Step 3: Fill the wooden box with thermal insulation material (fiber, product model GREENFIBER@, INS541LD) to cover the light fixture 100 so that the light fixture 100 is completely buried in the thermal insulation material; and Step 4: Provide power to the light fixture 100 to emit light at least two hours (in a thermally stable state). Dig a small hole in the light source cover 164 and use a thermocouple to pass through the light source cover 164, and measure the temperature the position of the carrier 161 next to the light emitting structure 162 which is located in the center of the carrier 161 (in this embodiment, the temperature of the carrier 161 next to the first light emitting group 162A is measured and is referred to as a center temperature).

When the second lid body 14 is a metal or a thermal conductive plastic material, the center temperature can be measured as 70 to 105 degrees through the above-mentioned thermal measurement step. Besides, in the present disclosure, the junction box 13 and the second lid body 14 are not tightly connected. A space S is formed between the junction box 13 and the second lid body 14 so that the heat generated by the light emitting structure 162 is not easily transmitted to the junction box 13. Most of the heat is conducted downward and transferred to the second lid 15 via the metal second lid body 14 to exchange heat with the outside environment. As a result, the electronic control module in the junction box 13 can be prevented from being damaged due to excessive temperature, and the light emitting structure 162 can also be prevented from reducing the efficiency due to excessive temperature. In addition, the space S makes the second lid body 14 to have a part contacted with the air and without contacted with the heat insulating material. When the junction box 13 is a plastic material, the manufacturing cost can be reduced. In one embodiment, when the second lid body 14 is a plastic material (non-thermally conductive plastic), the center temperature can be measured that is greater than 105 and less than 130 degrees through the above-mentioned thermal measurement steps.

According to the above description, it can be known that the light fixture of the present disclosure can be easily assembled on a carrier (for example, the design of the elastic component 156, the spring 118, or the fixing component 19). In addition, the second lid 15 of different colors and shapes can be selected according to the needs of the environment to increase overall appearance.

Figure 10A:
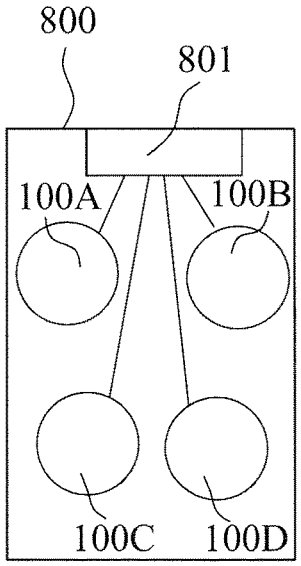
FIG. 10A is a schematic diagram of connection of a plurality of light fixtures in an embodiment of the present disclosure.
Figure 10B:
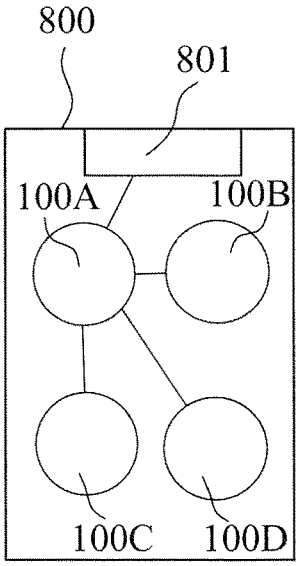
FIG. 10B is a schematic diagram of connection of a plurality of light fixtures in an embodiment of the present disclosure.
Figure 10C:
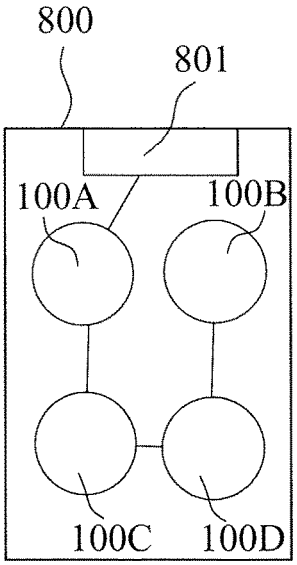
FIG. 10C is a schematic diagram of connection of a plurality of light fixtures in an embodiment of the present disclosure.

Furthermore, the arrangement of the top plate 111 and the pull plate 112 allows external cords inserted or removed, and simplifies the design of external cords. For example, in the present embodiment, one inlet (one top plate, inlet) and three outlets (two pull plates and one top plate, outlet) can be considered. In detail, as shown in FIG. 10A, in a space 800, when there are a plurality of light fixtures (four) to be disposed, if there is no design of the top plate and the pull plate, each light fixture 100A~D must be directly connected to the external power source 801 (commercial power). As shown in FIG. 10B and FIG. 10C, the light fixture itself can be served as a connection relay body through the design of the top plate and the pull plate. Therefore, as shown in FIG. 10B, only the light fixture 100A needs to be electrically connected to the external power source (commercial power), and the other light fixtures 100B-D can be electrically connected to the external power source (commercial power) through the light fixture 100A, thereby reducing the distance of the external cords and the complexity of the external cords arrangement. Similarly, as shown in FIG. 10C, light fixture 100A is connected to an external power source; light fixture 100C is connected to light fixture 100A; light fixture 100D is connected to light fixture 100C; and light fixture 100B is connected to light fixture 100D. The number and shape of the top plate and pull plate can be changed according to actual requirements, but not limited thereto.

Figure 11:
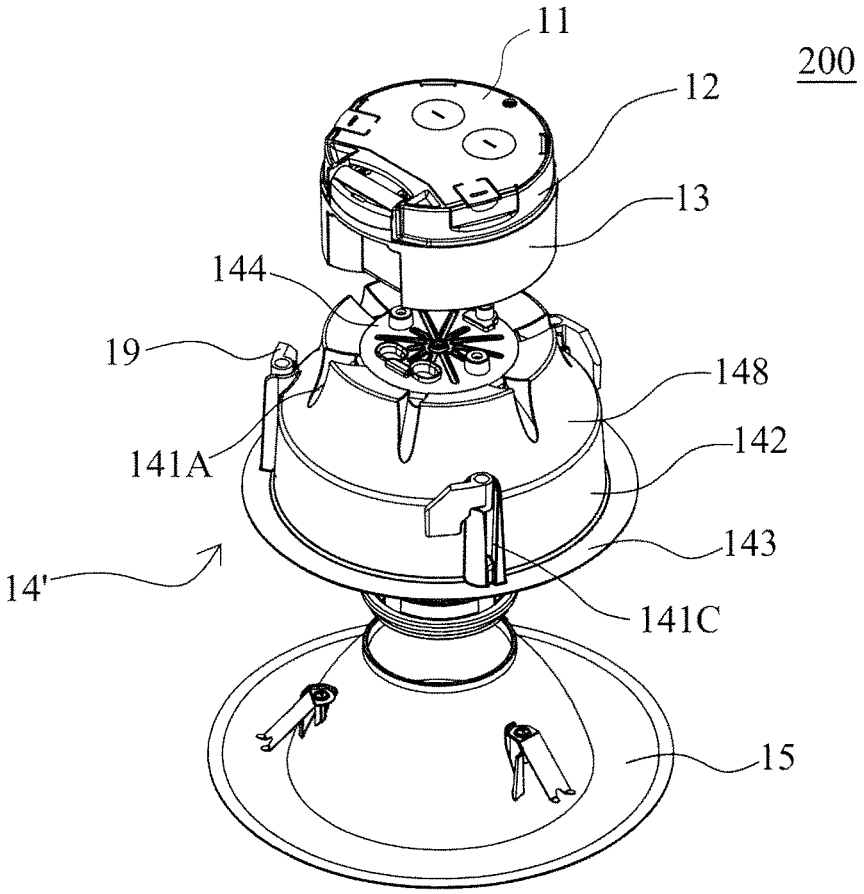
FIG. 11 is an exploded perspective view of a light fixture in an embodiment of the present disclosure.

FIG. 11 shows an exploded perspective view of a light fixture 200 in an embodiment of the present disclosure. The light fixture 200 has a similar structure to the light fixture 100, wherein the same symbols or marks correspond to elements or apparatus that have similar or identical elements or apparatus. The second lid body 14' further includes a middle portion 148 connected between the body 142 and the carrier support 144. The first groove 141A is located in the middle portion 148. The third groove 141C is located in the body 142. The second lid body 14' does not include the second groove 141B so that the fixing component 19 is only rested on the middle portion 148 in a stowed state. By the buffer design of the middle portion 148, the aperture (D2, for example: 6 inches) of the second lid body 14' can be enlarged, and the sizes of the first lid 11, the first lid body 12 and the junction box 13 do not need to be changed. Furthermore, the middle portion 148 can also increase the heat dissipation area so that the light fixture 200 can be operated at high wattages.

Figure 12:
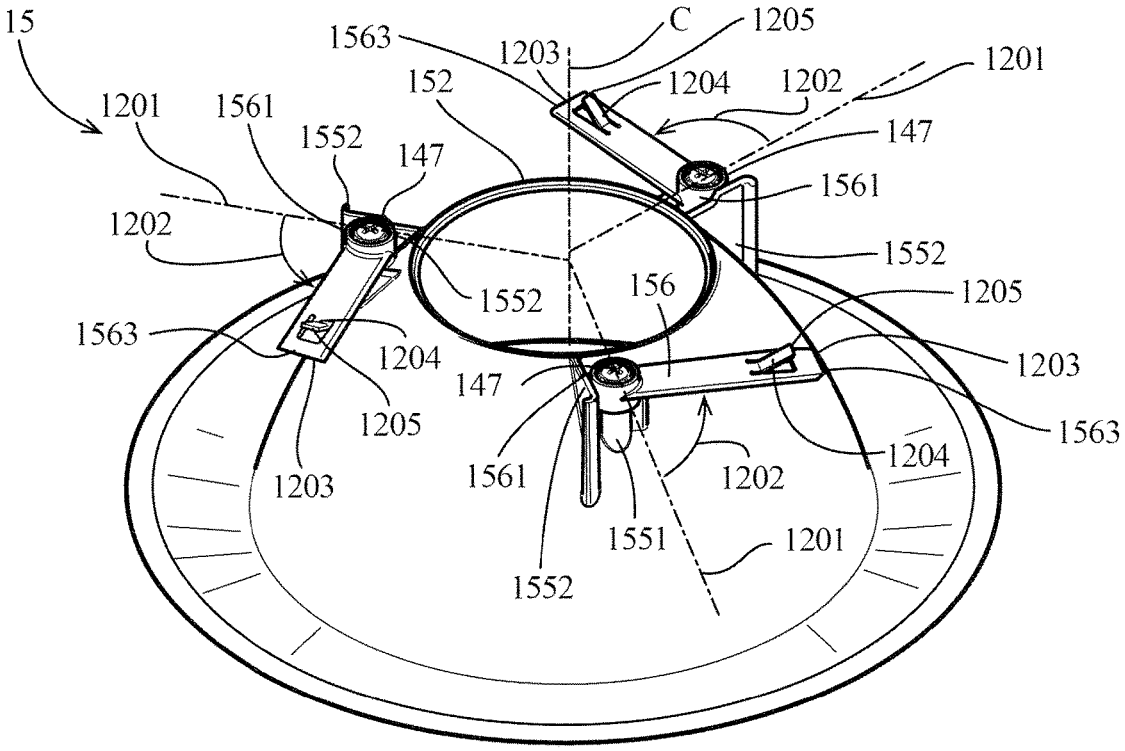
FIG. 12 is a perspective view of the second lid comprising elastic components in the disengaged position in accordance with another embodiment of the present disclosure.
Figure 13:
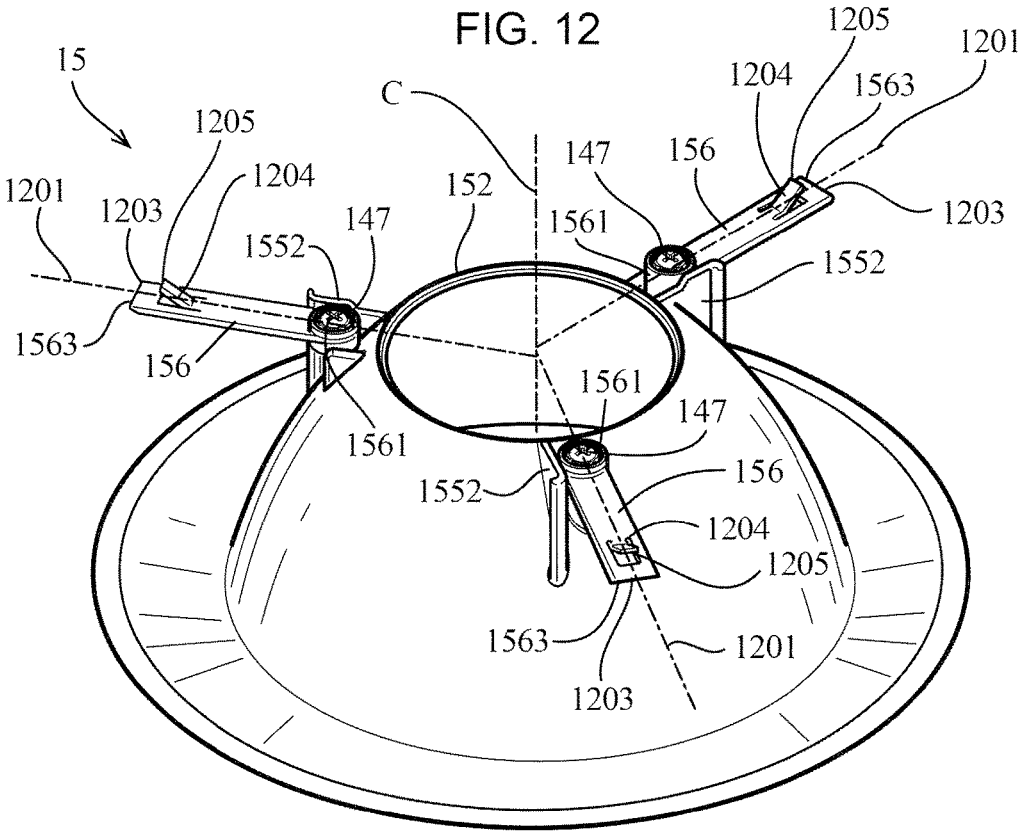
FIG. 13 is a perspective view of the second lid of FIG. 12 with the elastic components in the engaged position.

FIGS. 12 and 13 show perspective views of the second lid 15 of FIGS. 1A and 1B comprising an elastic component 156 in accordance with the present disclosure. The elastic component 156 can be in the disengaged position in FIG. 12 and the elastic component 156 can be angled inward in a rotational direction 1202 relative to a radial direction 1201 of the central axis (C). The elastic component 156 can be in the engaged position and aligned with the radial direction 1201 of the central axis (C) in FIG. 13. In the present embodiment, the elastic component 156 can extend outwards in the radial direction 1201 relative to the central axis (C) in the engaged position without extending axially upward or downward with respect to the central axis (C). In other embodiments, the elastic component 156 can also extend axially upward or downward with respect to the central axis (C).

To replace the teeth 1564 shown in FIGS. 4A and 7A, a first beveled edge 1203 is formed in the bottom portion 1563. Additionally, the elastic component 156 can contain a retention tab 1204 disposed proximately to the bottom portion 1563. Each retention tab 1204 can extend outwards from the respective elastic component 156 proximate to the bottom portion 1563, and each retention tab 1204 has a second beveled edge 1205. When the top end 152 is inserted into a second lid body 14, which is shown in FIG. 1, both the beveled edges 1203, 1205 of each elastic component 156 can engage with the inner surface 1421 (inner surface 1421 shown in FIG. 4B) to secure the second lid 15 within the second lid body 14. In some embodiments, the beveled edges 1203, 1205 can engage with a plurality of grooves or a plurality of ridges defined by the inner surface 1421, similar to the plurality of grooves 1505 shown in FIGS. 15 and 16.

Figure 14:
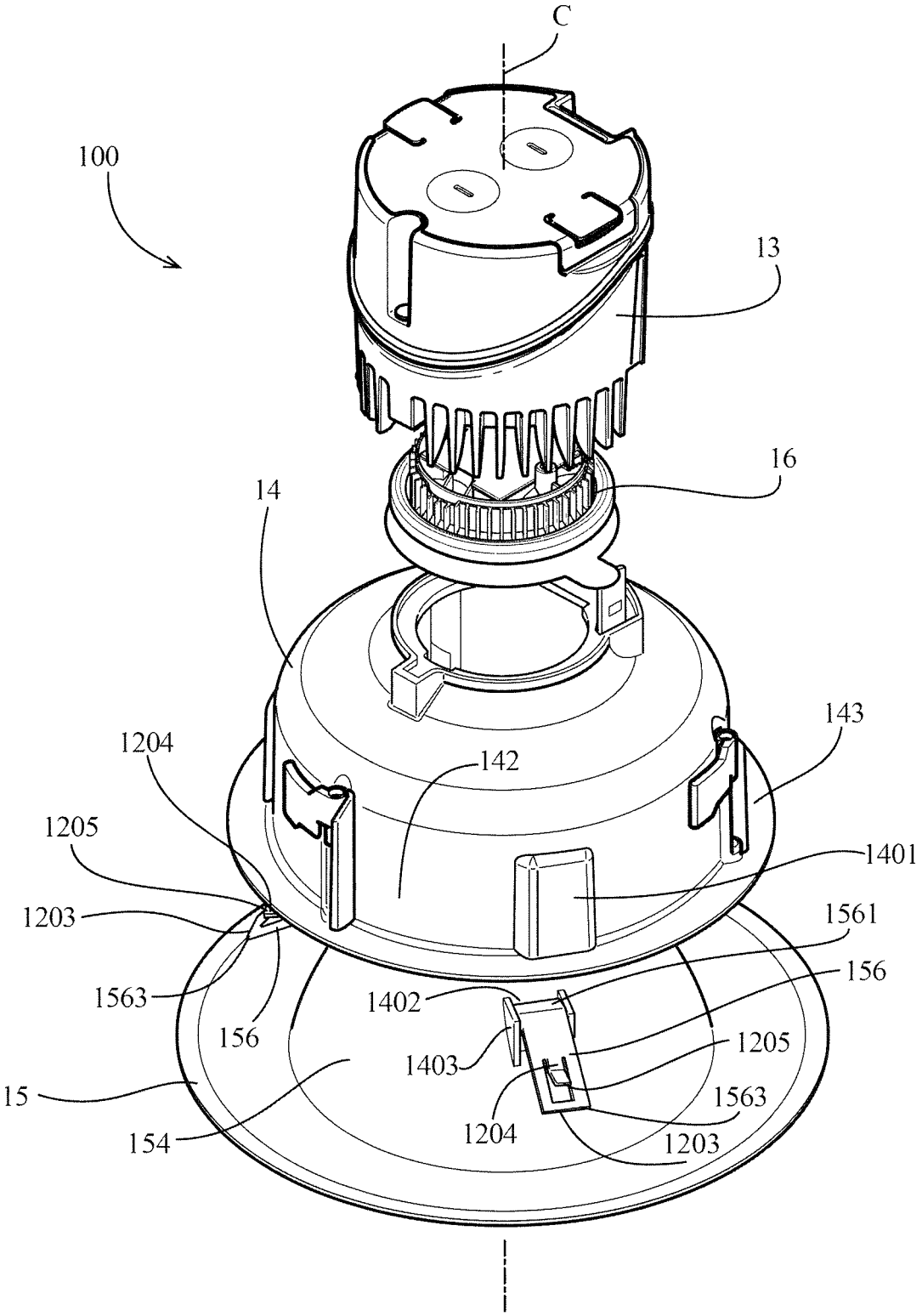
FIG. 14 is an exploded perspective view of a light fixture in accordance with another embodiment of the present disclosure.

FIG. 14 is an exploded perspective view of a light fixture 100 in accordance with another embodiment of the present disclosure. In the embodiment, the light fixture 100 can be sized for a 6" diameter nominal opening. The second lid body 14 comprises protuberances 1401 which can extend outwards from the body 142 of the second lid body 14 and down to the shoulder 143. The protuberances 1401 can correspond to pockets 1501 shown in FIG. 15 which can extend outwards from the second lid body bore 1502 shown in FIG. 15, and the pockets 1501 can receive the elastic component 156 of the second lid 15.

The light fixture 100 of the present embodiment comprises a second lid 15 and elastic component 156 in accordance with another embodiment of the present disclosure. In the present embodiment, the second lid 15 comprises three elastic components 156 which can be equally circumferentially spaced around the second lid 15. The elastic component 156 comprises the first beveled edges 1203, the retention tabs 1204, and the second beveled edges 1205, and in the present embodiment, the elastic component 156 can be attached and rotationally fixed to bases 1403. The bases 1403 can be disposed around the outer side surface 154 of the second lid 15. In other embodiments, the bases 1403 can be disposed at the top end 152 shown in FIG. 15. A slot 1402 can be defined by the base 1403 and the elastic component 156 can each comprise a locking tab 1503 shown in FIG. 15 at the top portion 1561. The locking tabs 1503 can be received and secured within the slots 1402 to secure each elastic component 156 to the respective base 1403.

Figure 15:
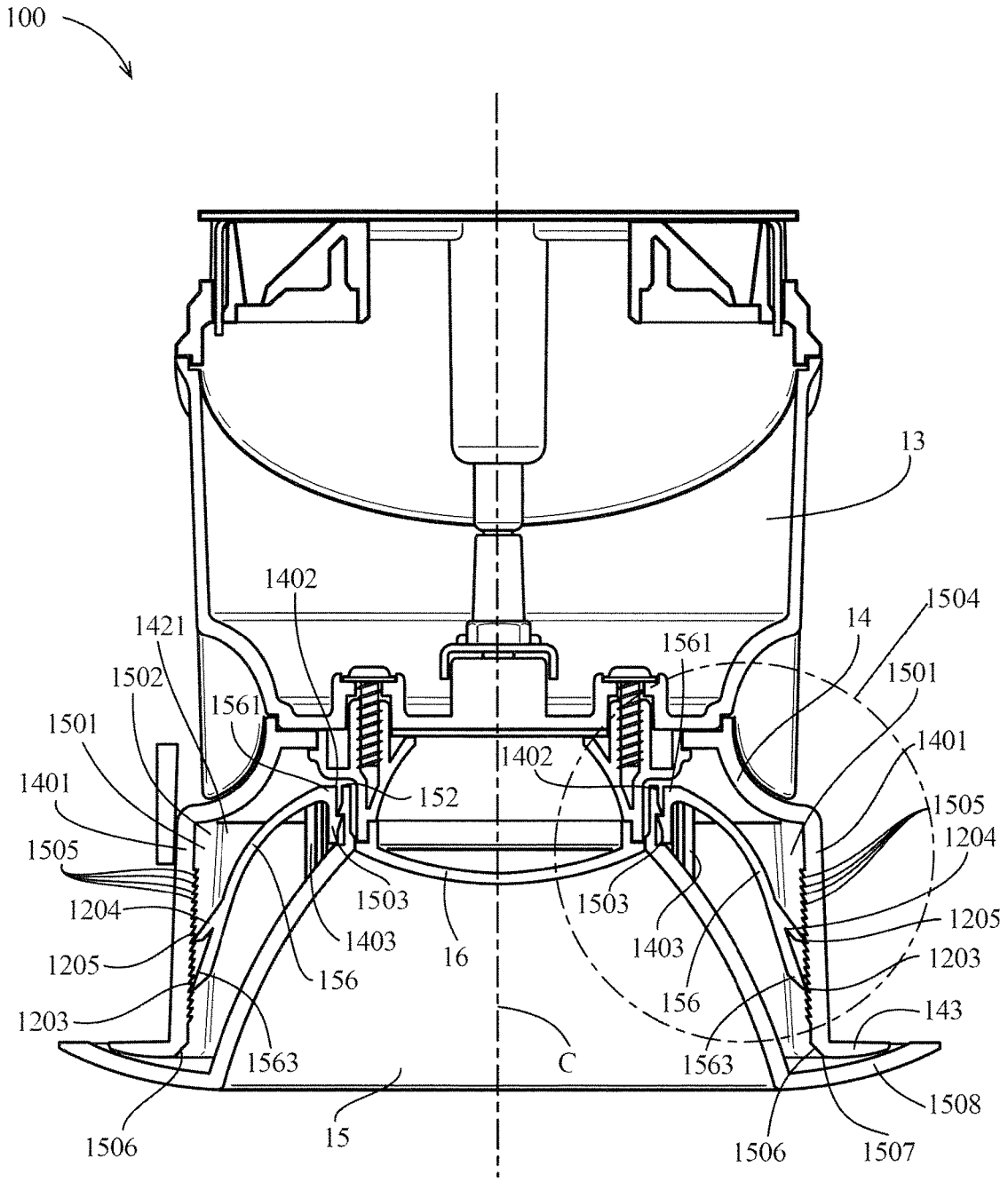
FIG. 15 is a cross-sectional view of the light fixture of FIG. 14 comprising the second lid in accordance with another embodiment of the present disclosure.
Figure 16:
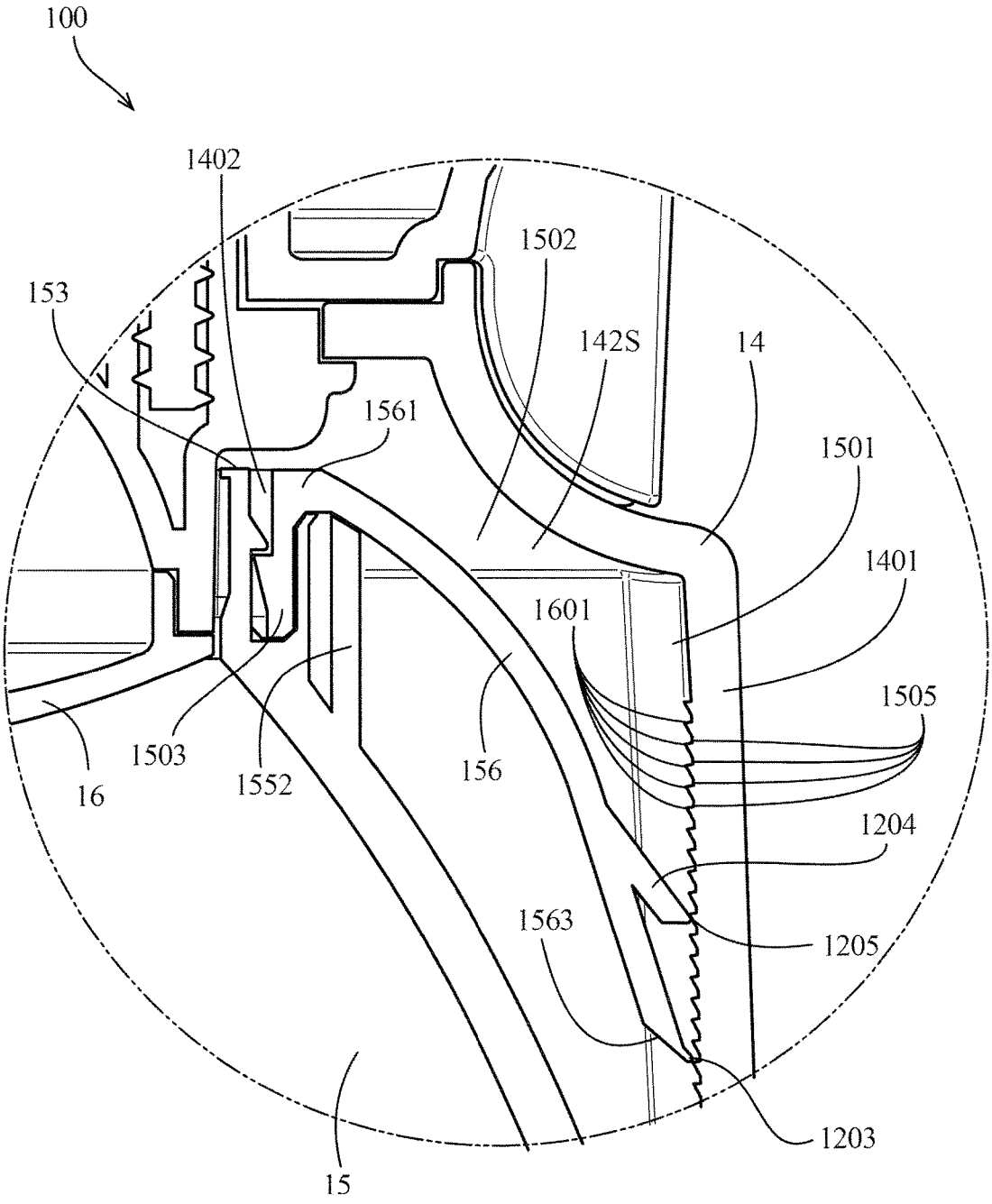
FIG. 16 is a detailed cross-sectional view of the light fixture of FIG. 15 taken from Section 1504 shown in FIG. 15.

FIG. 15 is a cross-sectional view of the light fixture 100 of FIG. 14 comprising the second lid 15 and second lid body 14 in accordance with another embodiment of the present disclosure. In the present embodiment, the second lid 15 comprises two elastic components 156 of the embodiment of FIG. 14 secured to two bases 1403 positioned opposite from one another. FIG. 16 is a detailed cross-sectional view of the light fixture 100 of FIG. 15 taken from Section 1504 shown in FIG. 15. As shown, the inner surface 1421 can define the pockets 1501 which can extend radially outwards from the second lid body bore 1502 within the respective protuberances 1401. The pluralities of grooves 1505 can be defined by the inner surface 1421 within each pocket 1501. As shown in FIG. 16, the plurality of grooves 1505 can be defined by adjacent ridges of a plurality of raised ridges 1601. In other embodiments, the grooves 1505 can extend into the inner surface 1421.

The bottom portions 1563 of the elastic component 156 can be received by the pockets 1501 which can cause the bottom portions 1563 to deflect radially inward and axially downward with respect to the central axis (C). A pocket chamfer 1506 can be defined between a bottom second lid body end 1507 and each of the pockets 1501. The angled pocket chamfer 1506 can guide the bottom portions 1563 radially inward when the second lid 15 is aligned and inserted into the second lid body bore 1502. Deflection of the bottom portions 1563 can engage the beveled edges 1203, 1205 with the respective pluralities of grooves 1505, and the elastic component 156 can exert a residual radially outward force acting against the grooves 1505 to prevent the second lid 15 from being withdrawn from the second lid body bore 1502.

Figure 17:
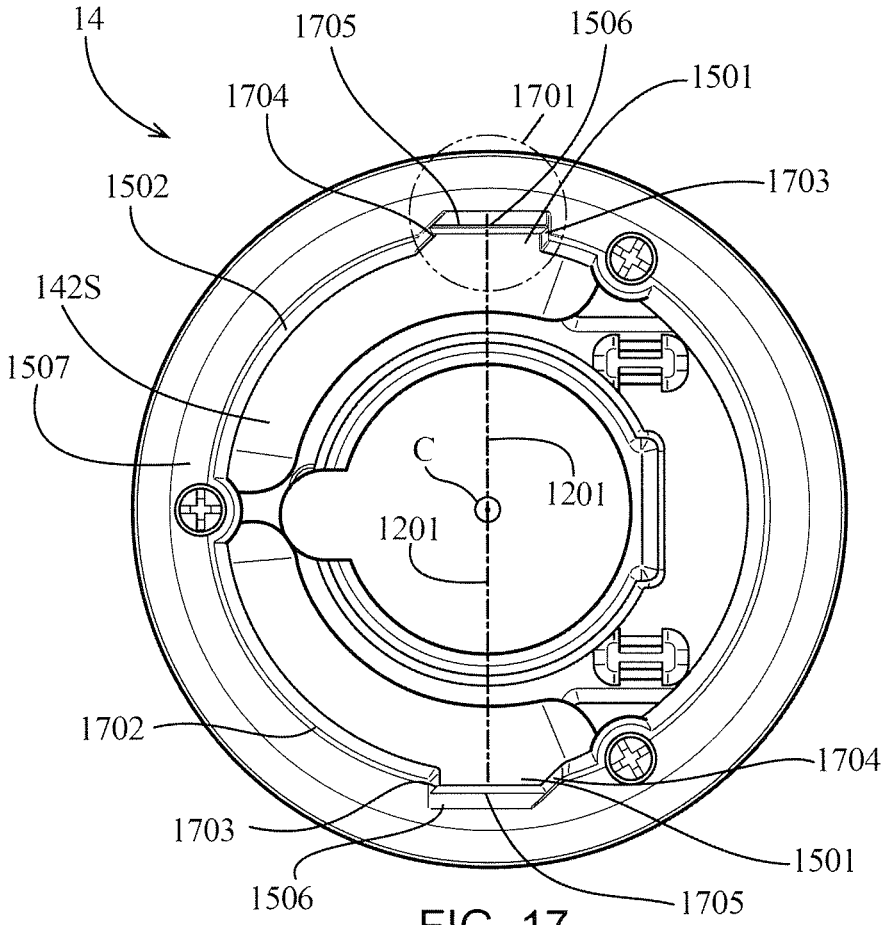
FIG. 17 is a bottom view of the second lid body of FIG. 15.
Figure 18:
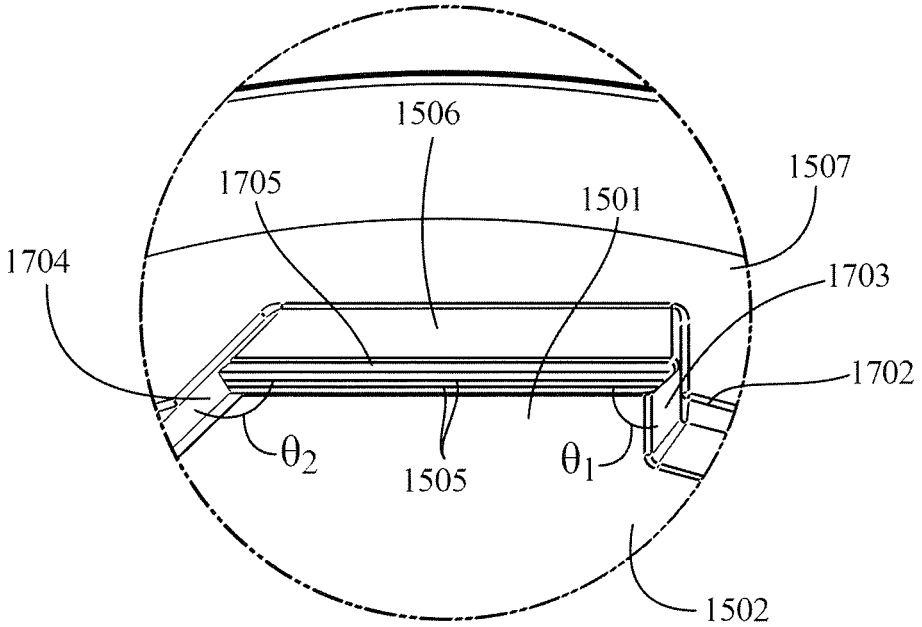
FIG. 18 is a detailed view of a pocket of the second lid body of FIG. 15 taken from Section 1701 shown in FIG. 17.

FIG. 17 is a bottom view of the second lid body 14 of the light fixture 100 of FIG. 15, and FIG. 18 is a detailed view of one of the pockets 1501 of FIG. 17 taken from Section 1701 shown in FIG. 17. The pockets 1501 can extend outwards from a bottom opening 1702 of the second lid body bore 1502. In the present embodiment, each pocket 1501 comprises a first pocket sidewall surface 1703, a second pocket sidewall surface 1704, and a pocket back wall surface 1705. The pocket back wall surface 1705 can extend between the respective pocket sidewall surfaces 1703, 1704, and the pocket back wall surfaces 1705 can be substantially perpendicular to the radial direction 1201 of the central axis (C). The inner surface 1421 can define the plurality of grooves 1505 on the pocket back wall surfaces 1705, and the grooves 1505 can extend between the adjacent pocket sidewall surfaces 1703, 1704, substantially perpendicular to the radial direction 1201 of the central axis (C).

A first angle $\theta_1$ can be defined between the first pocket sidewall surface 1703 and the pocket back wall surface 1705, and a second angle $\theta_2$ can be defined between the second pocket sidewall surface 1704 and the pocket back wall surface 1705, as shown in FIG. 18. In the present embodiment, the first pocket sidewall surface 1703 can be a square pocket sidewall surface which can be substantially perpendicular to the adjacent pocket back wall surface 1705 and parallel to the radial direction 1201 of the central axis (C). The first angle $\theta_1$ can be substantially equal to 90-degress. In the present embodiment, the second pocket sidewall surface 1704 can be an angled pocket sidewall surface, and the second angle 74 $_2$ can be an obtuse angle, such as 135-degrees for example and without limitation. Values of the angles are not limiting and are provided for exemplary purposes. In other embodiments, values of the angles $\theta_1$, $\theta_2$ are larger or smaller than the aforementioned value.

When the elastic component 156 engages with the grooves 1505 as shown in FIGS. 15 and 16, the second lid 15 shown in FIG. 15 cannot be withdrawn from the second lid body bore 1502 of the second lid body 14. Rotating the second lid 15 relative to the second lid body 14 can make the bottom portions 1563 of the elastic component 156 in contact with the second pocket sidewall surfaces 1704. Because of the angled orientation of the second pocket sidewall surfaces 1704, further rotation of the bottom portions 1563 towards the second pocket sidewall surfaces 1704 can deflect the bottom portions 1563 radially inward with respect to the central axis (C), thereby disengaging the beveled edges 1203, 1205 (shown in FIG. 15) from the grooves 1505. In effect, the second pocket sidewall surfaces 1704 can act as ramps which can lift the beveled edges 1203, 1205 out of the grooves 1505.

With the elastic component 156 disengaged from the grooves 1505, the second lid 15 can be withdrawn from the second lid body bore 1502 of the second lid body 14. In some embodiments, both of the pocket sidewall surfaces 1703, 1704 can be angled pocket sidewall surfaces, and the second lid 15 can be rotated in either direction relative to the second lid body 14 to disengage the elastic component 156 and release the second lid 15 from the second lid body 14. The second lid 15 can be re-secured to the second lid body 14 by simply aligning the elastic component 156 with the pockets 1501 and stabbing the top end 152 into the second lid body bore 1502 until a second lid rim 1508 (shown in FIG. 15) contacts the shoulder 143. Stabbing the top end 152 into the second lid body bore 1502 comprises axially translating the second lid 15 along the central axis (C) without rotating the second lid 15 about the central axis (C).

In some embodiments, the grooves 1505 can be defined by the inner surface 1421 within the second lid body bore 1502 rather than within the pockets 1501. In such embodiments, the grooves 1505 can be broken into circumferential arc-shaped portions with ungrooved portions of the inner surface 1421 circumferentially spaced between grooved portions of the inner surface 1421. In such embodiments, the bottom portions 1563 of the elastic component 156 can be aligned with the grooved portions to secure the second lid 15 to the second lid body 14, and the bottom portions 1563 of the elastic component 156 can be aligned with the ungrooved portions to release the second lid 15 from the second lid body 14.

In some embodiments, the second lid body 14 comprises metal, such as aluminum, steel, zinc alloy, or any other suitable metal, and the second lid body 14 can act as a heat sink to draw heat away from the light source assembly 16. In other embodiments, the second lid body 14 comprises plastic material, such as polycarbonate, acrylonitrile butadiene styrene, or any other suitable plastic. In such embodiments, the second lid 15 can act as the heat sink, and the second lid 15 comprises heat conductive material such as a metal to draw heat away from the light source assembly 16.

In embodiments in which the second lid body 14 comprises a metal, the elastic component 156 defining the teeth 1564 can be desirable because the teeth 1564 can cut directly into the second lid body 14 without requiring grooves 1505 to engage. Because metal can be expensive to form and machine, omitting the grooves 1505 can save on manufacturing costs and manufacturing steps. However, the elastic component 156 having the beveled edges 1203, 1205 can be used with a metallic second lid body 14 having the grooves 1505. In embodiments in which the second lid body 14 comprises plastic, grooves 1505 or ridges 1601 can be formed easily and economically, and the elastic component 156 defining teeth 1564, beveled edges 1203, 1205, or a combination thereof can be utilized.

The second lid 15 can be easily installed and removed from the second lid body 14 by one hand. For example, an installer working on a ladder can hold the ladder with one hand and use the other hand to install or remove the second lid 15. The second lid 15 is simply installed by stabbing the top end 152 into the second lid body bore 1502 so that the elastic component 156 engages with the inner surface 1421. The second lid 15 can be axially stabbed into the second lid body bore 1502 without a twisting or rotational motion as required by a threaded retention mechanism. The second lid rim 1508 can be positioned flush with the shoulder 143 each time without the need for adjustment because the shoulder 143 can act as a positive stop for the second lid rim 1508. This eliminates the need for adjusting the light fixture 100 at height in order to eliminate gaps between the second lid rim 1508 and the ceiling.

It should be understood that the above embodiments of the present disclosure can be combined or replaced with each other in appropriate situations, rather than being limited to the specific embodiments described. The embodiments listed in the present disclosure are only used to illustrate the present invention, and are not intended to limit the scope of the present disclosure. Any obvious modification or change made by anyone to the present disclosure will not depart from the spirit and scope of the present disclosure.

What is claimed is:

1. A light fixture, comprising:

a junction box;

a first lid body hinged on the junction box;

a first lid over the junction box;

a second lid;

a second lid body located between the second lid and junction box; and a space between the junction box and the second lid body.

2. The light fixture of claim 1, further comprising a plurality of elastic components disposed on the second lid.

3. The light fixture of claim 2, further comprising a plurality of protrusions disposed on the second lid.

4. The light fixture of claim 3, wherein the plurality of elastic components are respectively fixed to the plurality of protrusions.

5. The light fixture of claim 3, wherein each of the plurality of protrusion comprises a cylinder and a baffle.

6. The light fixture of claim 5, wherein the plurality of elastic components are respectively fixed to the plurality of cylinders.

7. The light fixture of claim 2, wherein each of the plurality of elastic components comprises a top portion, an extending portion and a bottom portion.

8. The light fixture of claim 7, wherein the extending portion extends obliquely downward the top portion and the bottom portion extends outward from the extending portion.

9. The light fixture of claim 7, wherein the bottom portion comprise at least one tooth.

10. The light fixture of claim 7, wherein the bottom portion can define a first beveled edge.

11. The light fixture of claim 10, wherein the plurality of elastic components can each define a retention tab disposed proximate to the bottom portion.

12. The light fixture of claim 11, wherein each of the retention tabs can extend outwards from the respective elastic component proximate to the bottom portion, and can define a second beveled edge.

13. The light fixture of claim 12, wherein the second lid body comprises an inner surface, the first and second beveled edges can engage the inner surface to secure the second lid within the second lid body.

14. The light fixture of claim 7, wherein the second lid body comprises an inner surface, the extending portion is bent and the bottom portion is contacted with the inner surface when the second lid and second lid body are assembled.

15. The light fixture of claim 13, wherein the first and second beveled edges can engage a plurality of grooves defined by the inner surface.

16. The light fixture of claim 1, wherein the second lid body has a first groove, a second groove and a third groove.

17. The light fixture of claim 16, wherein a depth of the third groove is greater than a depth of the first groove and a depth of the second groove.

18. The light fixture of claim 16, wherein air can flow into the space through the first groove, the second groove and the third groove.

19. The light fixture of claim 1, wherein the first lid comprises a plate and the plate can be opened.

20. The light fixture of claim 1, wherein the first lid comprises a buckle and the first lid is fixed to the first lid body by the buckle.

* * * * *